US009176438B2

(12) United States Patent
Yamashina et al.

(10) Patent No.: US 9,176,438 B2
(45) Date of Patent: Nov. 3, 2015

(54) IMAGE FORMING APPARATUS AND METHOD OF ARRANGING SHEET DETECTOR

(71) Applicants: Ryota Yamashina, Kanagawa (JP); Takumi Waida, Kanagawa (JP); Hiroshi Seo, Kanagawa (JP); Takashi Seto, Kanagawa (JP)

(72) Inventors: Ryota Yamashina, Kanagawa (JP); Takumi Waida, Kanagawa (JP); Hiroshi Seo, Kanagawa (JP); Takashi Seto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/193,260

(22) Filed: Feb. 28, 2014

(65) Prior Publication Data

US 2014/0270822 A1 Sep. 18, 2014

(30) Foreign Application Priority Data

Mar. 15, 2013 (JP) ..... 2013-053446
Jan. 17, 2014 (JP) ..... 2014-006737

(51) Int. Cl.
*G03G 15/00* (2006.01)
*G03G 15/20* (2006.01)

(52) U.S. Cl.
CPC ..... *G03G 15/2046* (2013.01); *G03G 15/5029* (2013.01); *G03G 15/6588* (2013.01); *G03G 2215/00599* (2013.01); *G03G 2215/00603* (2013.01); *G03G 2215/00751* (2013.01)

(58) Field of Classification Search
CPC ..... G03G 15/5029; G03G 15/657; G03G 15/6588; G03G 15/6591; G03G 15/6594; G03G 2215/00599; G03G 2215/00603; G03G 2215/00751; G03G 2215/00742; G03G 2215/00738
USPC ..... 399/45, 68, 69, 400
See application file for complete search history.

(56) References Cited

U.S. PATENT DOCUMENTS

| | | | | |
|---|---|---|---|---|
| 5,689,757 | A * | 11/1997 | Ferrante et al. | 399/45 |
| 7,792,452 | B2 * | 9/2010 | Fujikura | 399/69 |
| 8,725,018 | B2 * | 5/2014 | Sato | 399/68 |
| 8,918,003 | B2 * | 12/2014 | Kawai et al. | 399/69 |
| 2001/0053294 | A1 * | 12/2001 | Yamada et al. | 399/66 |
| 2002/0181963 | A1 * | 12/2002 | Takeda | 399/45 |
| 2006/0083528 | A1 * | 4/2006 | Mori et al. | 399/67 |
| 2007/0201891 | A1 * | 8/2007 | Cho | 399/67 |

(Continued)

FOREIGN PATENT DOCUMENTS

| | | |
|---|---|---|
| JP | 4-315188 | 11/1992 |
| JP | 10048975 A * | 2/1998 |

(Continued)

*Primary Examiner* — Robert Beatty
(74) *Attorney, Agent, or Firm* — Oblon, McClelland, Maier & Neustadt, L.L.P.

(57) ABSTRACT

An image forming apparatus includes an image forming device to form a toner image on a recording medium under a prescribed image forming condition, a fixing device to fix the toner image borne on the recording medium thereonto by heating the recording medium based on target fixing temperature, and a detector to detect a type of recording medium. The type is used in setting at least one of the image forming condition and the target fixing temperature. The inequality Tb>Ta is established when Ta represents a time period needed to reach a setting of fixing temperature allocated to the recording medium with its tip detected by the detector after detection of the tip and Tb represents a time period needed for the recording medium with its tip detected by the detector to reach the fixing device after detection of the tip.

15 Claims, 18 Drawing Sheets

(56) References Cited

U.S. PATENT DOCUMENTS

| | | | | |
|---|---|---|---|---|
| 2008/0292346 | A1* | 11/2008 | Tsubaki | 399/67 |
| 2009/0245827 | A1* | 10/2009 | Matsumoto | 399/45 |
| 2010/0008684 | A1 | 1/2010 | Matsumoto | |
| 2011/0222927 | A1 | 9/2011 | Yamashina | |
| 2015/0071660 | A1* | 3/2015 | Yamashina et al. | 399/45 |
| 2015/0071661 | A1* | 3/2015 | Yamashina et al. | 399/45 |
| 2015/0078770 | A1* | 3/2015 | Yamano et al. | 399/45 |

FOREIGN PATENT DOCUMENTS

| | | | |
|---|---|---|---|
| JP | 10-160687 | | 6/1998 |
| JP | 2001312181 | A * | 11/2001 |
| JP | 2002-340518 | | 11/2002 |
| JP | 2003-285484 | | 10/2003 |
| JP | 2004-258397 | | 9/2004 |
| JP | 2005-241954 | | 9/2005 |
| JP | 2006-062842 | | 3/2006 |
| JP | 2006154455 | A * | 6/2006 |
| JP | 2006-292952 | | 10/2006 |
| JP | 2009223229 | A * | 10/2009 |
| JP | 2010-002702 | | 1/2010 |
| JP | 2010-019979 | | 1/2010 |
| JP | 2012-194445 | | 10/2012 |

* cited by examiner

HIGH SMOOTHNESS-DIFFUSION PROCESSING

LOW SMOOTHNESS-LINE PROCESSING

IMAGE FORMING APPARATUS AND METHOD OF ARRANGING SHEET DETECTOR

CROSS-REFERENCE TO RELATED APPLICATIONS

This patent application is based on and claims priority pursuant to 35 U.S.C. §119(a) to Japanese Patent Application Nos. 2013-053446, filed on Mar. 15, 2013 and 2014-006737, filed on Jan. 17, 2014 in the Japan Patent Office, the entire disclosures of which are hereby incorporated by reference herein.

BACKGROUND

1. Technical Field

This invention relates to an image forming apparatus, such as a copier, a facsimile, a printer, a multifunction device prepared by combining these devices, etc., and a method of arranging a sheet detector implemented in the image forming apparatus.

2. Related Art

A so-called image forming apparatus, such as a digital copier, a laser printer, etc., that employs electrophotography generally forms an image by transferring a toner image onto a recording medium such as a recording sheet, etc., and fixing the toner image onto the recording medium while pressing and heating the toner image under prescribed conditions.

In such an image forming apparatus, heat and pressure or the like must be adjusted to appropriately fix the toner image. Especially when a high-quality image is to be formed on the recording medium, a condition of fixing the toner image needs to be set differently depending the type of recording medium because the quality of the image printed on the recording medium is greatly influenced by the material, thickness, humidity, smoothness, and coating or the like of the recording medium, where coating generally means coating and printing with ink or paint and the like. The smoothness is represented by the time it takes (in seconds) for a prescribed quantity of air to flow through a gap formed between the sheet and a testing board tightly contacting each other.

Here, a smoothness and fixability of the recording medium (e.g., a sheet) are highly correlated to each other. This is because, a fixing rate of toner changes in a recess of irregularities of the recording medium depending on a degree of the irregularities. Therefore, not only a low-quality image is obtained, but also an unusual image such as defective fixing, etc., is produced in some cases if the smoothness is neglected in fixing the toner image.

Meanwhile, as image forming apparatuses have gotten better and as methods of representation have become more diverse, there now exists hundreds of different types of recording sheets (e.g., recording media). That is, there is a wide range of brands of each type of recording sheet, with different basis weight and a thickness or the like. Therefore, to form a high-quality image, fixing conditions need to be set in detail in accordance with the type of sheet and the brand or the like of the recording medium.

For example, as the type of recording medium, a plain paper sheet, a coated paper sheet, such as a gross coated paper sheet, a mat coated paper sheet, an art coated paper sheet, etc., an OHP sheet, and a special sheet prepared by embossing a surface of a sheet, etc., are exemplified. The special sheet is increasingly utilized in recent years. Furthermore, there exists media other than the recording sheet.

With current image forming apparatuses, it is extremely common to set fixing conditions in accordance with a basis weight of the recording sheet. Typically, recording media are classified by basis weight, such that a sheet having a basic weight of from about 60 g/m$^2$ to about 90 g/m$^2$ is a plain paper sheet, a sheet having a basic weight of from about 91 g/m$^2$ to about 105 g/m$^2$ is a medium cardboard, and a sheet having a basic weight of from about 106 g/m$^2$ to about 200 g/m$^2$ is a cardboard and so on. Subsequently, fixing temperature and conveying speed of the recording medium are varied by classification.

The basic weight of the recording medium is generally listed on the package of the recording medium or the like, thereby enabling a user to ascertain the basis weight easily. This information is important because generally the user needs to set the above-described basis weight information by himself or herself, thus adding an extra step to preparation for printing. In addition, if the user erroneously sets the above-described basis weight information, an intended high-quality image cannot be obtained. Accordingly, an image forming apparatus capable of detecting a thickness of a recording medium with a sensor and automatically selecting a given recording medium has been researched in the past.

By contrast, since the smoothness of the recording medium is not usually printed on the package, it is extremely hard for a user to ascertain the smoothness by himself or herself. For this reason, the user is forced to use a sensor, etc., to obtain the smoothness of the recording medium.

Moreover, as mentioned earlier, the smoothness is highly correlated to the fixability. However, the smoothness is hard to detect within a short time period because the smoothness represents the time required for a prescribed quantity of air to flow through a gap formed between a sheet and a testing board contacting each other. Therefore, in the past, a sensor capable of detecting an amount of surface roughness or quantity of reflected light as alternative characteristics to smoothness has been employed because of the high correlation between surface roughness or quantity of light on the one hand and to the smoothness on the other.

As a known system to detect the smoothness of the recording medium, a light ray emitted from a light source such as a light-emitting diode (LED) is emitted onto a recording medium, and quantity of light reflected back from the recording medium is detected. According to the above-described reflection light system, since the smoothness can be detected without contacting the recording medium, the recording medium is not damaged.

As a known smoothness detecting method based on this type of a light reflecting system, quantity of light emitted and reflected in a regular reflecting direction from a surface of the recording medium is detected, and a smoothness thereof is calculated based on the detected luminous energy. Another known system includes multiple luminous energy detectors to detect not only quantity of light emitted and reflected from a surface of the recording medium in a regular reflective direction but also quantity of diffused light as well in order to identify the smoothness of the recording medium based on these two quantities of light.

The smoothness detected in these detecting systems is used in setting image forming and fixing conditions such as fixing temperature, etc.

A given time is generally needed from when image formation is started to when either an image is transferred onto a recording medium or the fixing temperature practically reaches a target level thereof. Accordingly, in an image forming apparatus that utilizes a detected smoothness of a recording medium in setting fixing and image forming conditions, the smoothness needs to be detected considering the above described given time as needed. Accordingly, positioning and detection timing of the smoothness detector are particularly important.

However, in the above-described image forming apparatuses, neither optimum positioning nor detection timing of the smoothness detector is determined considering a prescribed time period from when image formation is started to when either an image is transferred onto a recording medium or fixing temperature practically reaches a target thereof.

Some image forming apparatuses include a sheet thickness detector to detect a thickness of a recording medium, etc., and change one or more fixing conditions in accordance with the thickness of the recording medium. Even in these image forming apparatuses, however, to appropriately set a fixing condition, positioning and detecting timing of the sheet thickness detector are particularly important.

SUMMARY

Accordingly, one aspect of the present invention provides a novel image forming apparatus that includes an image forming device to form a toner image on a recording medium under a prescribed image forming condition, a fixing device to fix the toner image borne on the recording medium thereonto by heating the recording medium based on target fixing temperature, and a detector to detect a type of recording medium. The type is used in setting at least one of the image forming condition and the target fixing temperature. The following inequality is established when Ta represents a time period needed to reach a setting of fixing temperature allocated to the recording medium with its tip detected by the detector (after detection of the tip) and Tb represents a time period needed by the recording medium with its tip detected by the detector (after detection of the tip) to reach the fixing device; Tb>Ta.

Another aspect of the present invention provides a novel method of arranging a detector in an image forming apparatus comprising the steps of: forming a toner image onto a recording medium under a prescribed image forming condition; fixing the toner image borne on the recording medium thereonto by heating the recording medium based on target fixing temperature; detecting the type of recording medium, the type being used in setting at least one of the image forming condition and the target fixing temperature; and arranging the detector to establish Tb>Ta, where Ta represents a time period needed for a fixing device to reach a setting of fixing temperature allocated to the recording medium with its tip detected by the detector after detection of the tip and Tb represents a time period needed by the recording medium to reach the fixing device after detection of the tip.

Yet another aspect of the present invention provides a novel method of arranging a detector in an image forming apparatus comprising the step of: forming a toner image onto a recording medium under a prescribed image forming condition; fixing the toner image borne on the recording medium thereonto by heating the recording medium based on target fixing temperature; detecting a smoothness of the surface of the recording medium by detecting an quantity of regular light emitted to the recording medium from a light source and reflected in a specular direction therefrom; and arranging the detector to establish Td>Tc, wherein Tc represents a time after a tip of the recording medium is detected by the smoothness detector until the detected value is fixed and Td represents a time until the image forming device starts image forming operation based on the image forming condition allocated to the recording medium after detection of the tip.

BRIEF DESCRIPTION OF THE DRAWINGS

A more complete appreciation of the present invention and many of the attendant advantages thereof will be more readily obtained as substantially the same becomes better understood by reference to the following detailed description when considered in connection with the accompanying drawings, wherein.

DETAILED DESCRIPTION

Figure 1:
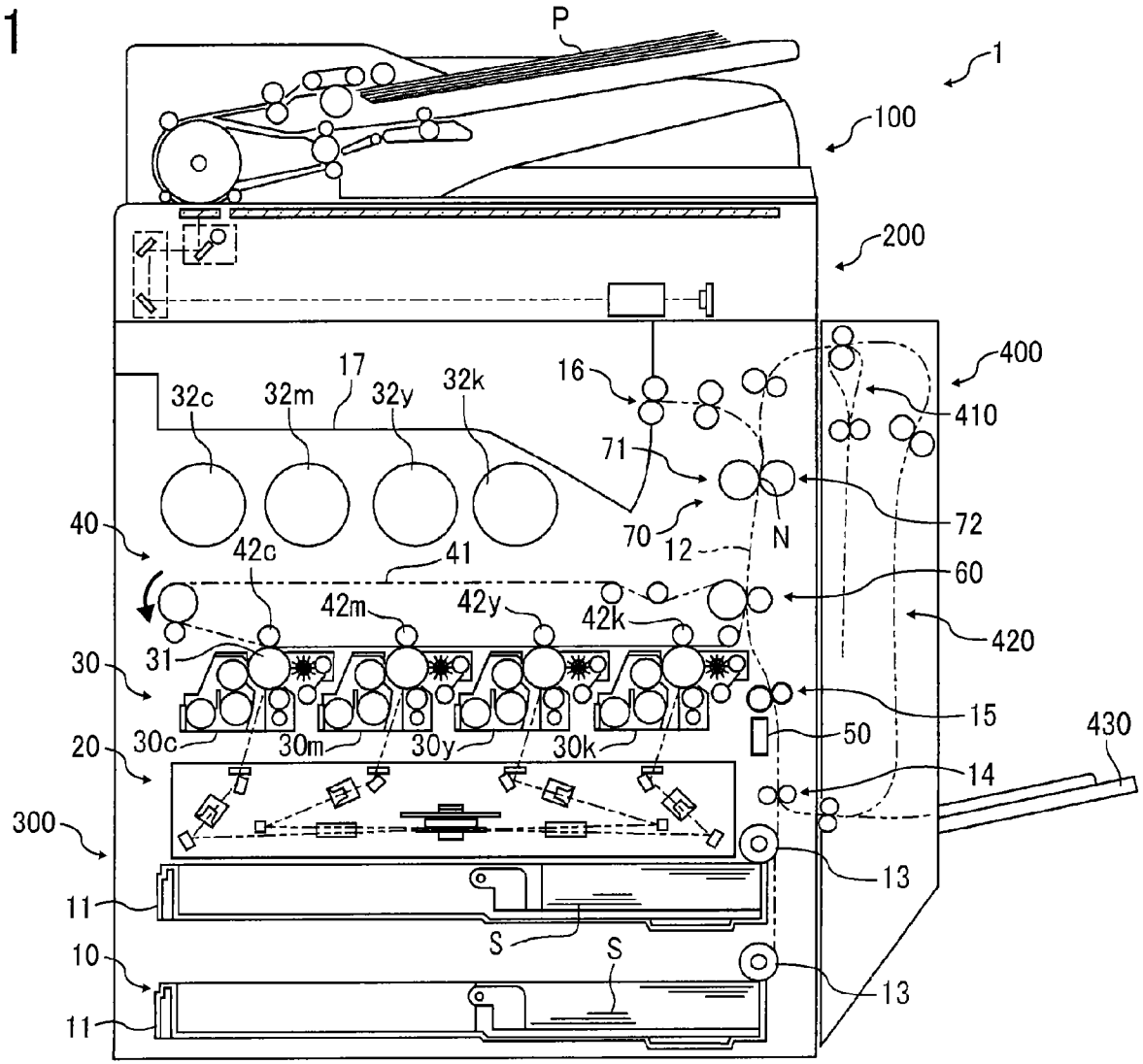
FIG. 1 is a schematic cross-sectional view illustrating an exemplary image forming apparatus according to one embodiment of the present invention.

Referring now to the drawings, wherein like reference numerals designate identical or corresponding parts throughout the several views thereof and in particular to FIG. 1, an exemplary interior of a typical image forming apparatus employing an electrophotography is described.

As shown in FIG. 1, the image forming apparatus 1 of this embodiment includes a manuscript sheet conveying unit 100, an image reading unit 200, an image forming apparatus body 300, and a both side copy conveying device (hereinafter, also referred to as a duplex unit) 400 placed on one side of the image forming apparatus body 300.

The manuscript sheet conveying unit 100 employs an automatic manuscript sheet conveying device to hold multiple manuscript sheets P and automatically extract and convey the topmost manuscript sheet P in order. The manuscript sheet conveying unit 100 is optionally mounted on the image forming apparatus 1.

Further, the manuscript sheet conveying unit 100 is enabled to open from the image reading unit 200 around an axis 200 located in a back side of the image forming apparatus 1. However, the manuscript sheet conveying unit 100 can employ a publicly known system not described here in detail.

The image reading unit 200 is composed of a scanner unit and includes a function of reading an image of the manuscript sheet P conveyed by the manuscript sheet conveying unit 100 in a conveyance process and that of a stationed manuscript P (not shown). Image data obtained by scanning the image from either the manuscript sheet P or the fixed manuscript by the image reading unit 200 is outputted to the image forming apparatus body 300. It is to be noted that the image reading unit 200 can adopt a known configuration, which is not described in detail here.

The image forming apparatus body 300 includes a sheet feeding unit 10, an exposing unit 20, an operation device 30, an intermediate transfer unit 40, an optical sensor (i.e., a smoothness detector) 50, a secondary transferring unit 60, and the fixing device 70 in an order of an image forming process.

The sheet feeding unit 10 is installed on the bottom of the image forming apparatus body 300. The sheet feeding unit 10 is composed of multiple stages of drawer type sheet feeding cassettes 11. Although the sheet feeding unit 10 is composed of two steps of top and bottom sheet feeding cassettes 11 in this example, the pin is not limited thereto.

Each of the sheet feeding cassettes 11 is enabled to accommodate a recording medium S as an image transferred member such as a recording sheet, etc. Above a downstream end of each of the sheet feeding cassettes 11, a sheet feeding roller 13 is disposed to extract and feed the recording media S accommodated therein one by one from the top of the sheet tray 11 toward a sheet conveying path 12 vertically upwardly formed on the right side in the body.

The exposing unit 20 is placed above the topmost sheet feeding tray 11. The exposing device 20 emits laser light to the image forming device 30 based on image data obtained by scanning the manuscript sheet P or the fixed manuscript with the image reading unit 200 or image data received through a personal computer (herein below, simply called as a PC), not shown, or a telephone line.

The exposing unit 20 writes latent images of respective colors corresponding to the image data with the laser light beams on image bearing members (e.g., photoconductors) 31 electrically charged by the charging devices in the respective image forming devices 30*c*, 30*m*, 30*y*, and 30*k*. In general, the latent image written onto the respective image-bearing members 31 are sometimes called written latent images.

The image forming unit 30 includes the image forming devices 30*c*, 30*m*, 30*y*, and 30*k* for respective component colors of cyan (c), magenta (m), yellow (y), and black (k). The respective image forming systems 30*c*, 30*m*, 30*y*, and 30*k* are disposed side by side below the intermediate transfer belt 41 in a tandem state along a running path in which the intermediate transfer belt 41 circulates.

The respective image forming systems 30*c*, 30*m*, 30*y*, and 30*k* execute image forming processes of electrification, development, transferring (e.g. primary transferring), cleaning, and electric charge removing in this order on the drum-shaped image-bearing members 31 which rotate clockwise as shown in FIG. 1. The respective image forming systems 30*c*, 30*m*, 30*y*, and 30*k* supply toner T as developer from toner bottles 32*c*, 32*m*, 32*y*, and 32*k* corresponding to component colors.

An intermediate transfer unit 40 is composed of the endless intermediate transfer belt 41 horizontally stretched and wound around multiple rollers, and is enabled to move and circulate counterclockwise in the drawing. Here, the term endless represents a condition in which both ends of a belt is connected to each other omitting a joint there.

The intermediate transfer unit 40 includes multiple primary transferring devices 42*c*, 42*m*, 42*y*, and 42*k* confronted by the respective image-bearing members 31 of the image forming devices 30*c*, 30*m*, 30*y*, and 30*k* across the intermediate transfer belt 41. The respective primary transferring devices 42*c*, 42*m*, 42*y*, and 42*k* transfer toner images of respective colors formed on the image-bearing members 31 onto the intermediate transfer belt 41 to form respective primary transfer images (e.g., a black and white dual color or a multicolor image and the like).

An optical sensor 50 uses a sensor system that detects a smoothness of a front surface (or a rear surface) of the recording medium S conveyed in the sheet conveying path 12 without contacting it. The optical sensor 50 is described more in detail later.

A secondary transferring unit 60 is placed on the sheet conveying path 12 to secondarily transfer each of the color toner images formed as the primary transfer images on the intermediate transfer belt 41 onto the recording medium S.

The exposing unit 20, these primary transfer units 42*c*, 42*m*, 42*y*, and 42*k*, and the secondary transferring unit 60 of this embodiment collectively constitute the image forming device to form each of the color toner images on the recording medium S based on prescribed image forming conditions.

In the above-described given image forming conditions, image processing, developing, and transferring conditions or the like are included, for example. In the image processing conditions, an image processing method or the like implemented to process a halftone (dots) section in an image is included, for example. Further, in the transferring conditions, an amount of transfer current or the like changed in accordance with the above-described image processing method is included, for example.

The fixing device 70 includes a heating unit 71 located on the side of a front surface of the recording medium S to fix a color toner image transferred onto the recording medium S, and a pressing section (i.e., a pressing roller) 72 located on the backside of the recording medium S to press the heating unit 71. Specifically, the fixing device 70 fixes the color toner image onto the recording medium S by heating and pressing the recording medium S based on set fixing temperature (i.e., target fixing temperature) as described later in detail. The fixing device 70 of this embodiment as also described later in detail constitutes one of aspects of the fixing device of the present invention.

The duplex unit 400 is used to form images on both sides of the recording medium S, respectively, and includes a switch back unit 410 and a sheet inverting unit 420 serving together as a re-feeding conveying path. The duplex unit 400 includes a manual sheet feeding tray 430 to store a recording medium S manually supplied therefrom into the image forming apparatus body 300.

The recording medium S with the fixed image on its one side is then conveyed to the sheet inverting unit 420 with its upstream end being replaced with its downstream end in the switchback unit 410 in the sheet conveying direction. The sheet inverting unit 420 resupplies the recording medium S to the vicinity of the upstream end of sheet conveying path 12 via a path that supplies the recording medium S manually fed from the manual sheet feeding tray 430 to the image forming apparatus body 300.

Now, a copying function as an exemplary image forming process implemented in the image forming apparatus 1 is described.

Firstly, the image forming apparatus 1 writes latent images corresponding to respective color toner images of the manuscript image read by the image reading system 200 onto the surfaces of the image-bearing members 31 uniformly charged by the charging devices in the respective image forming units 30*c*, 30*m*, 30*y*, and 30*k* using the exposing unit 20.

Next, the image forming apparatus 1 forms toner images of each of component colors by providing each color toner particles from the developing units to each of the color toner latent images borne on the image-bearing members 31 in the image forming units 30*c*, 30*m*, 30*y*, and 30*k*, respectively.

Subsequently, the image forming apparatus 1 primarily transfers the toner images of respective colors borne on the image-bearing members 31 sequentially using the primary transferring devices 42*c*, 42*m*, 42*y*, and 42*k*, onto the intermediate transfer belt 41. Thus, a desired color image is formed on the intermediate transfer belt 41, for example.

Whereas, the image forming apparatus 1 selectively rotates one of sheet feeding rollers 13 disposed in the two-stage sheet feeding cassettes 11 and feeds the recording medium S from a corresponding stage of the sheet feeding cassettes 11. Otherwise, the image forming apparatus 1 feeds the recording medium S manually fed from the manual sheet feeding tray 430.

Subsequently, the image forming apparatus 1 conveys the recording medium S fed from one of the sheet feeding cassettes 11 or the manual sheet feeding tray 430 into the sheet conveying path 12. Subsequently, the image forming apparatus 1 conveys the recording medium S to a registration device 15 using a conveying roller 14 through the sheet conveying path 12.

Subsequently, the image forming apparatus 1 further conveys the recording medium S from the registration device 15 to a secondary transfer position of a secondary transferring unit 60 synchronizing with the color image borne on the intermediate transfer belt 41.

Here, the image forming apparatus 1 calculates a smoothness of the recording medium S using an optical sensor 50 arranged in the sheet conveying path 12 between the conveying roller 14 and the registration device 15 before transferring the color image borne on the intermediate transfer belt 41 onto the recording medium S using the secondary transferring unit 60.

Subsequently, the image forming apparatus 1 conveys the recording medium S with the transferred color image thereon to the fixing device 70 and fixes the color image onto the recording medium S by heating and pressing it at a nip N of the fixing device 70.

Here, to also form an image on the back side of the recording medium S, the image forming apparatus 1 conveys the recording medium S with the fixed color image on its one side to the duplex unit 400 using a switching nail (not shown) that toggles the sheet conveying path by divergence.

Subsequently, the recording medium S is conveyed to the sheet inverting unit 420 with its upstream end in the sheet conveying direction being replaced with its downstream end in a switchback section 410 of the duplex unit 400. The sheet inverting unit 420 resupplies the recording medium S to the vicinity of the upstream end of sheet conveying path 12 utilizing the path that supplies the recording medium S manually fed from the manual sheet feeding tray 430 to the image forming apparatus body 300.

Subsequently, the image forming apparatus 1 secondarily transfers the color image borne on the intermediate transfer belt 41 as a backside image onto the recording medium S, and fixes the color image onto the backside of the recording medium S using the fixing device 70 as executed onto the front side surface thereof.

When the color image has been completely fixed onto the recording medium S, the image forming apparatus 1 ejects and stacks the recording medium S from a sheet ejecting unit 16 acting as a sheet ejecting device onto an inner sheet exit tray 17 acting as an inner sheet exit section, thereby completing a series of image forming operation processes.

The optical sensor 50 is disposed on the downstream side of the conveying roller 14 and calculates a smoothness of the recording medium S fed into the conveying path 12 from either one of the sheet feeding cassettes 11 or the manual sheet feeding tray 430. More specifically, the optical sensor 50 is enabled to detect and identify the type of used recording medium S, which is utilized to set a fixing condition such as the later-described fixing temperature (e.g. target fixing temperature), etc., based on the calculated smoothness of the recording medium S. Thus, the optical sensor 50 constitutes a detector according to one aspect of the present invention.

As the detector to detect the type of recording medium S other than the above-described optical sensor 50, a sheet thickness sensor that detects a thickness of the recording medium S based on detecting result and identifies the type of recording medium S, etc., may be used. As the sheet thickness sensor, a system to identify a thickness based on a conveyance time for conveying the recording medium S among multiple sensors may be used, for example. Otherwise, another system that identifies the thickness based on a change in shadow area of the recording medium S, which appears in proportion to the thickness of the recording medium S when a video of its tip is taken and analyzed (read) may be used as well. Yet otherwise, a system that identifies the thickness by emitting light onto one side of a sheet bundle composed of multiple recording media S and detecting spilled light from another side of the sheet bundle. Specifically, various types of sheet thickness sensors can be used.

The optical sensor 50 is placed on the sheet conveying path between the registration device 15 and the conveying roller 14. With this, the smoothness of all of the recording media S passing through the sheet conveying path 12 can be calculated without employing multiple optical sensors 50 corresponding to the sheet tray 11 and the manual sheet feeding tray 430, respectively.

As a location of it in the image forming apparatus 1, the optical sensors 50 can be located near the top of the recording media S loaded on the respective sheet feeding cassettes 11, for example, to detect a surface of each of the recording media S. However, in such a situation, the number of the optical sensors 50 increases raising the cost. When the recording medium S is set to each of the sheet feeding cassettes 11, since the optical sensor 50 is positioned close to the recording medium S, the optical sensor 50 disturbs setting operation, and accordingly, a mechanism for removing the optical sensor 50, which links with opening and closing operation of the sheet feeding tray 11 (e.g. by separating it away from the top of the recording medium S) is needed at the same time, thereby making the mechanism complicated. Hence, to resolve the above-described problem, the optical sensor 50 is disposed on the downstream side of the conveying roller 14 as described above in this embodiment.

Figure 2:
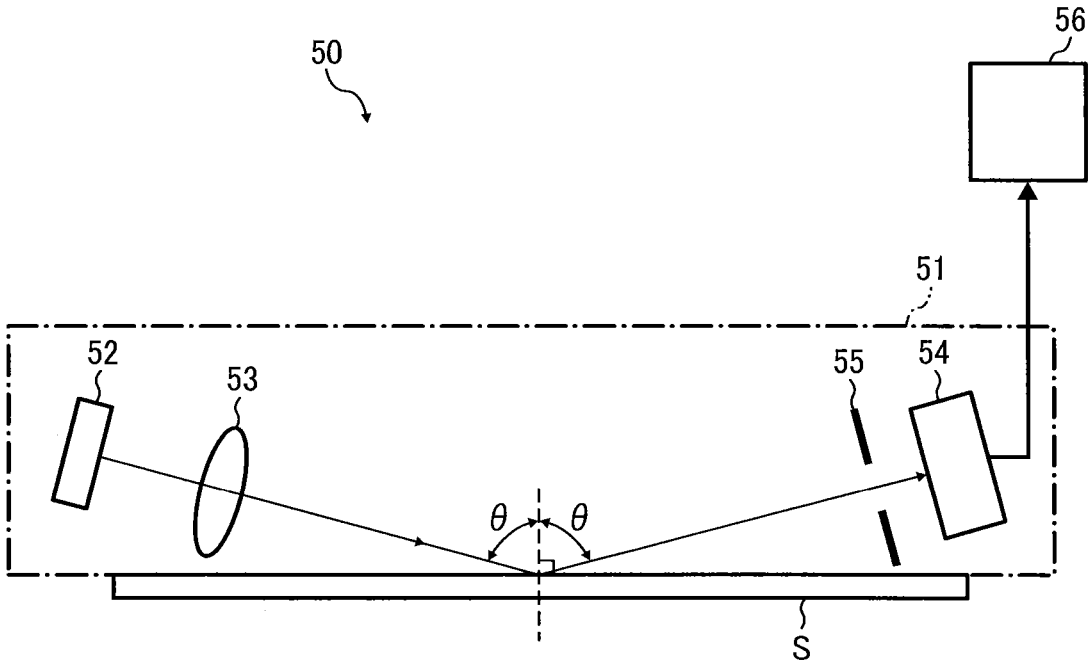
FIG. 2 is a diagram illustrating an exemplary optical sensor adopted into the image forming apparatus according to one embodiment of the present invention.

Now, the configuration of the optical sensor 50 is described more in detail with reference to FIG. 2.

As shown in FIG. 2, the optical sensor 50 is configured by including a housing 51, a light source 52 that emits detecting light toward a surface of the recording medium S, a collimating lens 53, a light receiver 54, an aperture 55, and a control unit 56. The light receiver 54 constitutes a regularly reflected light receiver as a light detector. The aperture 55 functions as an aperture diaphragm.

Hence, such components 51 to 56 collectively constitute the optical sensor 50 and are covered by the component 51 except for the control unit 56.

The light source 52 is configured by a surface-light emitting laser (VCSEL: Vertical Cavity Surface Emitting Laser). Specifically, the light source 52 can reduce a FFP (i.e., a Far Field Pattern) more effectively than an LED or an end LD (i.e., a Laser Diode) generally used as a light source, and accordingly, is able to constitute an optical system having better precision. Here, the FFP represents the angle of the beam. However, the light source 52 is not limited to the surface-light emitting laser and may be configured by various light sources such as LEDs, etc.

The collimating lens 53 is provided between the light source 52 and a light emitting surface of the recording medium S, and is composed of an aspherical convex lens that converts a laser beam flux emitted from the light source 52 into a collimated beam flux. Here, the collimating generally means conversion of a laser beam flux emitted from the light source 52 into a parallel beam flux not converging. Therefore, the collimated beam flux means a laser beam aligned in parallel to each other.

Thus, by adjusting both an angle of incidence θ of the laser beam emitted from the light source 52 and entering the recording medium S by using the collimating lens 53 and parallelism of the collimated beam as well, the optical sensor 50 can increase detection sensitivity of the smoothness of the recording medium S.

The light receiver 54 is provided downstream of a reflective surface of the recording medium S in an axial direction of the laser light beam emitted from the light source 52 and is configured by a photodiode or the like to detect a specular beam reflected by the surface of the recording medium S.

The light receiver 54 detects luminous energy of the regular reflection light flux reflected from the recording medium S and converts it into the voltage. The light receiver 54 then outputs a signal as detecting result to the control unit 56. This allows the optical sensor 50 to calculate the smoothness of the recording medium S using the control unit 56.

The aperture 55 is provided between the light emitting surface of the recording medium S and the light receiver 54 to limit the angle of the incidence of the reflected light beam entering the light receiver 54. Thus, by employing the aperture 55, the optical sensor 50 can maintain quantity (a value) of light emitted from the light source 52 and regularly reflected by the surface of the recording medium S, while reducing scattered light mingled with the regularly reflected light. Thus, deterioration of smoothness detection precision can be likely prevented.

The control unit 56 is electrically connected to the light receiver 54 and calculates the smoothness of the recording medium S based on a sensor value generated by the light receiver 54 in accordance with the quantity of the reflected light received (i.e., a value detected by the light receiver 54). A function of the control unit 56 is described later in more detail.

Specifically, since the optical sensor 50 configured in this way can receive the light beam of the detecting light emitted from the light source 52 and regularly reflected by the surface of the recording medium S in the specular direction with the light receiver 54, the smoothness of the surface of the recording medium S can be detected based on the quantity of the light using the control unit 56.

Here, the light receiver 54 employs a one-dimensional line sensor, for example. The control unit 56 detects the smoothness by calculating either an average of distribution of quantity of light (i.e., distribution of diffused quantity of light) received by the one-dimensional line sensor within a prescribed range, or an average of peak values (i.e., peak addresses) thereof.

Specifically, the optical sensor 50 detects a sheet of the recording medium S by multiple times, and calculates an overall average based on averages (or peak values) respectively obtained during the multiple detections of the sheet of the recording medium S as a smoothness. Otherwise, the optical sensor 50 can calculate the smoothness based on an average of quantity distribution of a continuous peak value generated over the whole range from a tip to the end of a sheet of the recording medium S in the conveying direction. Yet otherwise, by regarding the lowest value in each of peak values or an average thereof, obtained by detecting (the sheet of the recording medium S) multiple times, and the contiguous peak values obtained over the whole range from to the tip to the end of the sheet of the recording medium S as the recess of the recording medium S, the smoothness can be calculated based on the lowest value as well.

Now, an exemplary function of each of the units of the image forming apparatus 1 is described with reference to FIG. 3.

Figure 3:
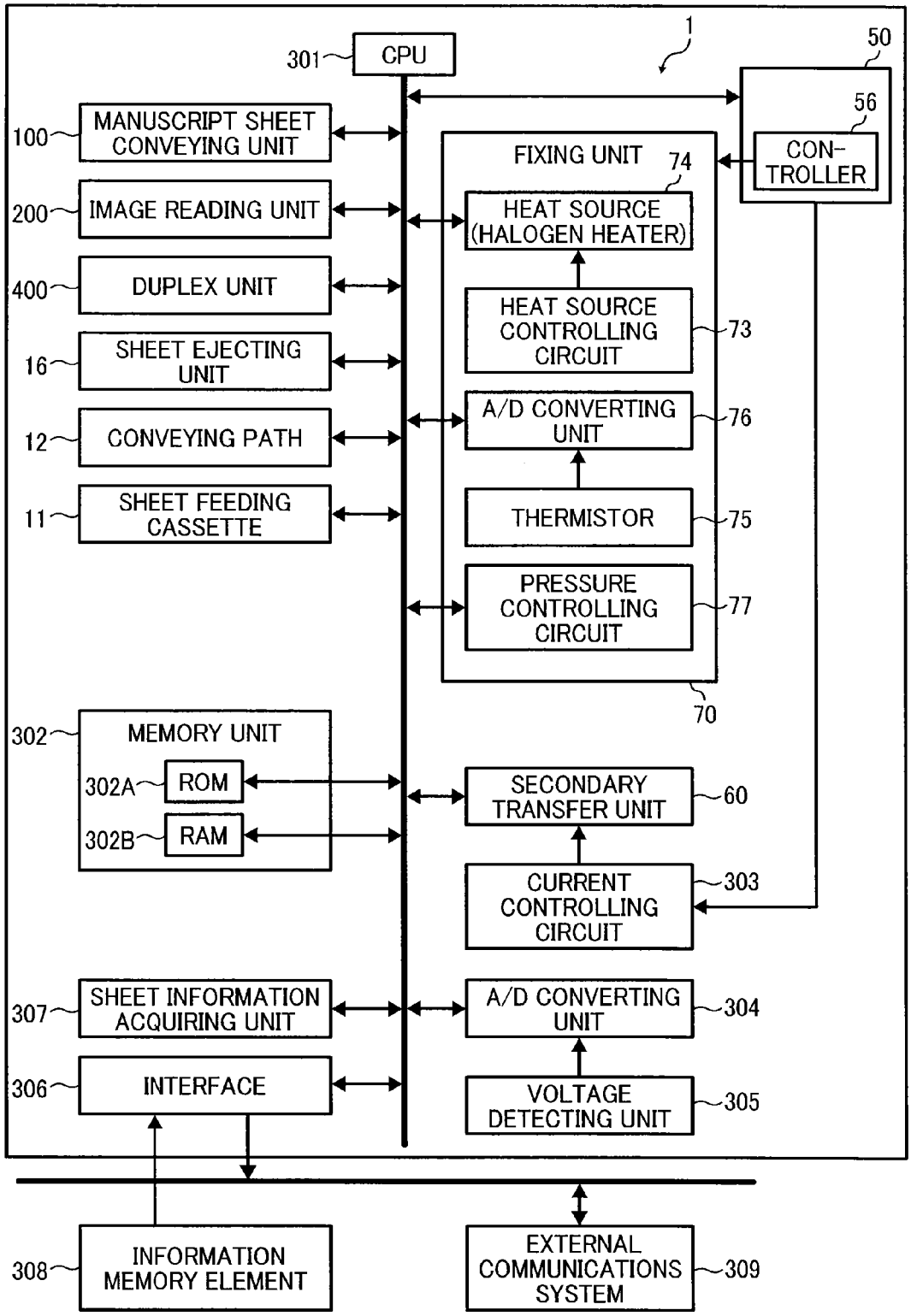
FIG. 3 is a block diagram illustrating an exemplary function of the image forming apparatus according to one embodiment of the present invention.

As shown in FIG. 3, in the image forming apparatus 1, a CPU (Central Processing Unit) 301 is electrically connected to each of elements (i.e., units) via bus lines, respectively. The CPU 301 controls each of the elements and renders the image forming apparatus 1 to exert its functions.

The CPU 301 is electrically connected by the multiple sheet feeding cassettes 11, the sheet conveying path 12, the secondary transferring unit 60, the sheet exiting unit 16, the fixing device 70, a memory unit 302, a current controlling circuit 303, an A/D (Analog to Digital) conversion unit 304, and a voltage detecting unit 305. An interface 306, a sheet informing acquiring unit 307, the optical sensor 50, the manuscript sheet conveying unit 100, the image reading unit 200, and the duplex unit 400 are also connected to the CPU 301.

The fixing device 70 includes a heat source controlling circuit 73 that determines a quantity of heat to be supplied to the heating unit 71 from the later described heat source 74. Specifically, the heat source controlling circuit 73 determines a setting value (i.e., a target) of fixing temperature of the heating unit 71. The fixing device 70 also includes a thermistor 75 that at least detects temperature of the heating unit 71.

Here, as described above, to obtain a high-quality image, the target fixing temperature needs to be determined by considering a smoothness that considerably highly correlates to fixability. Therefore, the heat source controlling circuit 73 according to this embodiment determines the target fixing temperature in accordance with a sensor value of the above-described optical sensor 50, specifically, the smoothness of the surface of the recording medium S. Thus, the heat source controlling circuit 73 of this embodiment constitutes one aspect of the fixing control device of the present invention.

Further, the fixing device 70 includes the A/D conversion unit 76 that converts an analog value detected by the thermistor 75 into a digital value to be handled by the CPU 301. The fixing device 70 then sends the digital value to the CPU 301. The fixing device 70 also includes a pressure controlling circuit 77 that controls both of pressure of the pressing member 72 pressed against the heating unit 71 and a width of the nip N formed therebetween.

Further, the control unit 56 of the optical sensor 50 is electrically connected to the fixing device 70. Thus, upon receiving a value detected by the control unit 56, the fixing device 70 activates the heat source controlling circuit 73 and the pressure controlling circuit 77.

The memory unit 302 includes a ROM (Read Only Memory) 302A and a RAM (Random Access Memory) 302B. The ROM 302A stores in it a program code and a fixing control pattern implemented by the CPU 301. A detected voltage is temporarily stored in the RAM 302B.

The CPU 301 reads the program code stored in the ROM 302A, and spreads it in the RAM 302B. The CPU 301 accordingly runs programs defined in the program code using the RAM 302B as a data buffer, thereby controlling each of the elements.

Here, the CPU 301 is enabled to change an image forming condition in accordance with the smoothness of the recording medium S inputted from the control unit 56 of the optical sensor 50, i.e. the sensor value transmitted from the optical sensor, as described later more in detail. Thus, the CPU 301 of this embodiment constitutes one aspect of the image formation controller according to the present invention.

The current controlling circuit 303 controls an amount of transferring current flown when the secondary transferring unit 60 transfers the toner image onto the recording medium S in accordance with a signal transmitted from the control unit 56 of the optical sensor 50.

To control under a stable power condition, the A/D conversion unit 304 converts an analog voltage detected by the voltage detecting unit 305 into a digital value to be handle by the CPU 301. The A/D conversion unit 304 then sends the digital value to the CPU 301.

The interface 306 serves as a connector to connect with an information storage device 308 such as a hard disk drive, etc., and an external communications device 309 such as a PC. Hence, the interface 306 captures image data from an outside into the image forming apparatus 1.

Now, an exemplary configuration of the fixing device 70 is described herein below with reference to FIG. 4.

Figure 4:
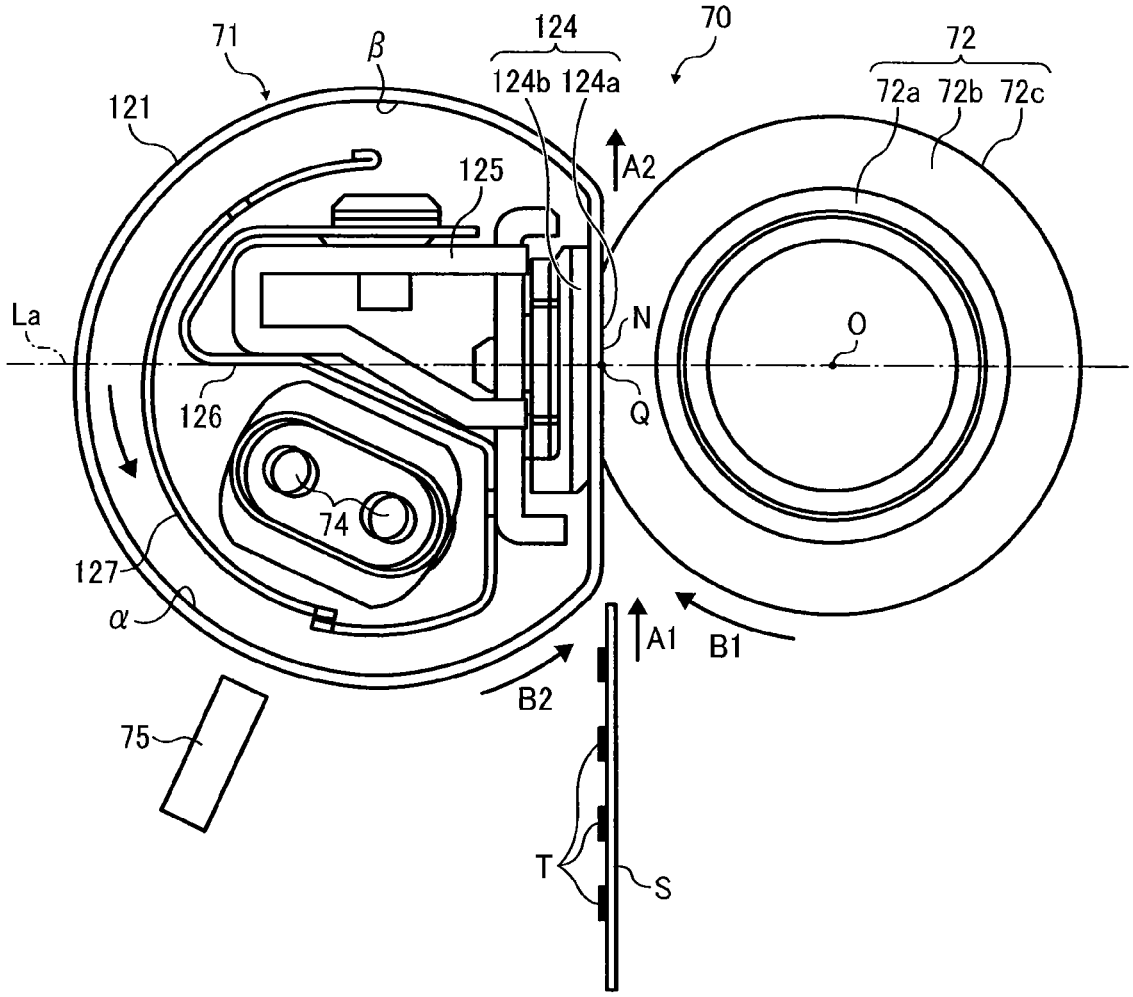
FIG. 4 is a cross-sectional view illustrating an exemplary fixing device (with a heat shielding system) provided in the image forming apparatus according to one embodiment of the present invention.

As shown in FIG. 4, the fixing device 70 includes the heating unit 71 having a fixing belt 121 acting as a fixing member, and the pressing member 72 contacting an outer circumferential surface of the fixing belt 121 as an opposed member. The fixing device 70 further includes the heat source 74 that heats the fixing belt 121. The fixing device 70 also includes a nip forming member 124 that contacts the pressing member 72 from inside a loop of the fixing belt 121 to form a nip N therebetween. The fixing device 70 also includes a stay 125 as a supporter to support the nip forming member 124. The fixing device 70 also includes a shielding member 127 that shields the heat emitted from the heat source 74, a reflection member 126 that reflects the heat emitted from the heat source 74 to the fixing belt 121, and the thermistor 75 as a temperature detector to detect temperature of the fixing belt 121 or the like.

The above-described fixing belt 121 is configured by an endless thin flexible belt such as a film, etc. More specifically, the fixing belt 121 is configured by an inner substrate and a mold-releasing layer located on an outer circumference side thereof. The inner substrate is made of metal, such as nickel, SUS (stainless steel), etc., or plastic such as polyimide (PI), etc. The mold-releasing layer located on the outer circumference side is made of tetrafluoroethylene-perfluoroalkylvinyl ether copolymer (PFA) or polytetrafluoroethylene (PTFE) and the like. Between the inner substrate and the mold-releasing layer, an elastic layer made of rubber, such as silicone rubber, foam silicone rubber, fluorine rubber, etc., can intervene as well.

Here, heat capacity decreases and fixing performance can be improved when the elastic layer is omitted. However, a fine unevenness of the surface of the belt may be transferred likely generating uneven gloss in a solid part of an image when an unfixed toner is crushed and fixed. To prevent this, the elastic layer desirably has a thickness of about 100 μm or more. That is, with the elastic layer having the thickness of about 100 μm or more, since the deformation of the elastic layer absorbs the fine unevenness, occurrence of the uneven gloss can be likely avoided.

In this embodiment, to decrease heat capacity of it, the fixing belt 121 is made thin relatively having a small diameter. Specifically, the substrate, the elastic layer, and the mold-releasing layer collectively constituting the fixing belt 121 have thicknesses of from about 20 μm to about 50 μm, from about 100 μm to about 300 μm, and from about 10 μm to about 50 μm, respectively, thereby totally having a thickness of about 1 mm or less. Whereas, a diameter of the fixing belt 121 is of from about 20 mm to about 40 mm. In order to ensure the low heat capacity, the total thickness of the fixing belt 121 is desirably about 0.2 mm or less, and more preferably about 0.16 mm or less. The diameter of the fixing belt 121 is desirably about 30 mm or less.

The above-described pressing member 72 is configured by a core metal 72*a*, an elastic layer 72*b* provided on a surface of the core metal 72*a*, and a release molding layer 72*c* provided on a surface of the elastic layer 72*b*. The release molding layer 72*c* is made of PFA or PTFE and the like. The elastic layer 72*b* is made of foam silicone rubber, silicone rubber, or fluorinated rubber and the like. The elastic layer 72*b* is pressed toward the fixing belt 121 by a switching mechanism, not shown, and contacts the nip forming member 124 through the fixing belt 121. In an area, in which the pressing member 72 and the fixing belt 121 contact each other, the elastic layer 72*b* of the pressing member 72 is crushed to form the nip N having a given width. The fixing member 121 and the opposed member (i.e., the pressing member 72) are not necessarily mutually brought in pressure contact with each other, and may simply touch each other without the pressure.

Further, the pressing member 72 is driven and rotated by a driving source such as a fixing motor, etc., not shown, provided in the image forming apparatus body 300. Thus, when the pressing member 72 is driven and rotated in a direction as shown by arrow B1, its driving force is propagated to the fixing belt 121 in the nip N, so that the fixing belt 121 can be driven and rotated in a direction as shown by arrow B2. Hence, the recording medium S with the toner T adhered during the transfer process of the color toner image is inserted into the nip N of the fixing device 70 in a direction as illustrated by arrow A1. The recording medium S is then sent in a direction as illustrated by arrow A2 after passing through the nip N while fixing the toner T thereon.

Here, although the pressing member 72 is composed of a solid roller in this embodiment, a hollow roller may be used as well. In such a situation, a heat source such as a halogen heater, etc., can be installed in the hollow pressing member 72 as well. Although the elastic layer 72*b* can be made of solid rubber, sponge rubber can be used as well when the pressing member 72 does not accommodate the heat source. When the sponge rubber is used, thermal insulation can be more desirably upgraded while suppressing leakage of heat from the fixing belt 121.

The above-described heat source 74 is disposed inside the loop of the fixing belt 121 on the upstream side of the nip N in a direction, in which the recording medium S is conveyed. Specifically in FIG. 4, when La represents a virtual liner line extended through a rotation center O of the pressing member 72 and a center Q of the nip N in a direction, in which the recording medium S is conveyed, the heat source 74 is disposed on the upstream side (i.e., a lower side in FIG. 4) of the virtual straight line La in the direction, in which the recording medium S is conveyed. The heat source 74 is configured to generate heat, because an output of a power supply (not shown) provided in the image forming apparatus body 300 is controlled by the heat source controlling circuit 73. The output is controlled based on surface temperature of the fixing belt 121 detected by the above-described thermistor 75. By controlling the output of the heat source 74 in this way, temperature of the fixing belt 121 (i.e., fixing temperature) can be set (controlled) to be a desired level.

Instead of the thermistor that detects temperature of the fixing belt 121, a temperature sensor is provided to detect temperature of the pressing member 72 (not shown), and temperature of the fixing belt 121 may be to predicted based on the temperature detected by the temperature sensor.

In this embodiment, although the heat source 74 includes two pieces of heaters, one or three or more pieces of heaters may be used as well in accordance with a size of the recording medium S used in the image forming apparatus 1. As the heat source 74 heating the fixing belt 121, an IH, a resistance heater, or a carbon heater and the like can be employed beside the halogen heater as well.

The above-described nip forming member 124 includes a base pad 124*a* and a sliding sheet 124*b* having a low friction provided on a surface of the nip forming member 124 opposed to the fixing belt 121. The base pad 124*a* is formed longitudinally extending in axial directions of the pressing member 72 and the fixing belt 121, respectively. Because the base pad 124*a* receives pressure from the pressing member 72, the shape of the nip N is determined.

Although, the shape of it is flat in this embodiment, the nip N can be a recess or the other shapes.

The above-described sliding sheet 124*b* is provided in order to reduce sliding friction when the fixing belt 121 rotates. Here, when the base pad 124*a* itself is made of low friction material, the sliding sheet 124*b* can be omitted.

The base pad 124*a* is made of heat-resistant material capable of enduring temperature over 200° C. With such a configuration, deformation of the nip forming member 124 generally caused by heat in a toner fixing temperature range is likely prevented while stabilizing a condition of the nip N, and accordingly, quality of an output image. Here, the base pad 124*a* is required to have reasonable rigidity to ensure its strength.

As material of the base pad 124*a* that meets the above-described conditions, resin, such as polyethersulphone (PES), polyphenylene sulfide (PPS), etc., can be exemplified. Further, resin, such as liquid crystal polymer (LCP), polyether nitrile (PEN), polyamide-imide (PAI), polyether ether ketone (PEEK), etc., can be employed as well. Furthermore, the base pad 124*a* can also made of metal or ceramic.

The base pad 124*a* is fixed and supported by a stay 125. Hence, deflection of the nip forming member 124 generally caused by pressure applied by the pressing member 72 can be likely prevented, so that the nip width is uniformed in the axial direction of the pressing member 72. To exert a function to prevent the deflection of the nip forming member 124, the stay 125 is desirably made of metal having high mechanical strength, such as stainless steel, iron, etc.

The above-described reflection member 126 is fixed to the stay 125 while facing the heat source 74. Thus, by reflecting radiant heat emitted from the heat source 74 to the fixing belt 121 with the reflection member 126, the radiant heat is prohibited to travel to the stay 125 or the like. Accordingly, the fixing belt 121 is effectively heated while promoting energy conservation as well. As material of the reflection member 126, aluminum and stainless steel or the like can be used. Especially, when the material of the reflection member 12 is prepared by depositing silver having a low emissivity (i.e., highly reflective) on a substrate made of aluminum, heating effectiveness of the fixing belt 121 can be considerably improved.

The above-described shielding member 127 is configured by an arc-shaped metal plate having a thickness of from about 0.1 mm to about 1.0 mm along the inner circumferential surface of the fixing belt 121. The shielding member 127 is movable between the fixing belt 121 and the heat source 74 in the circumferential direction.

Figure 5:
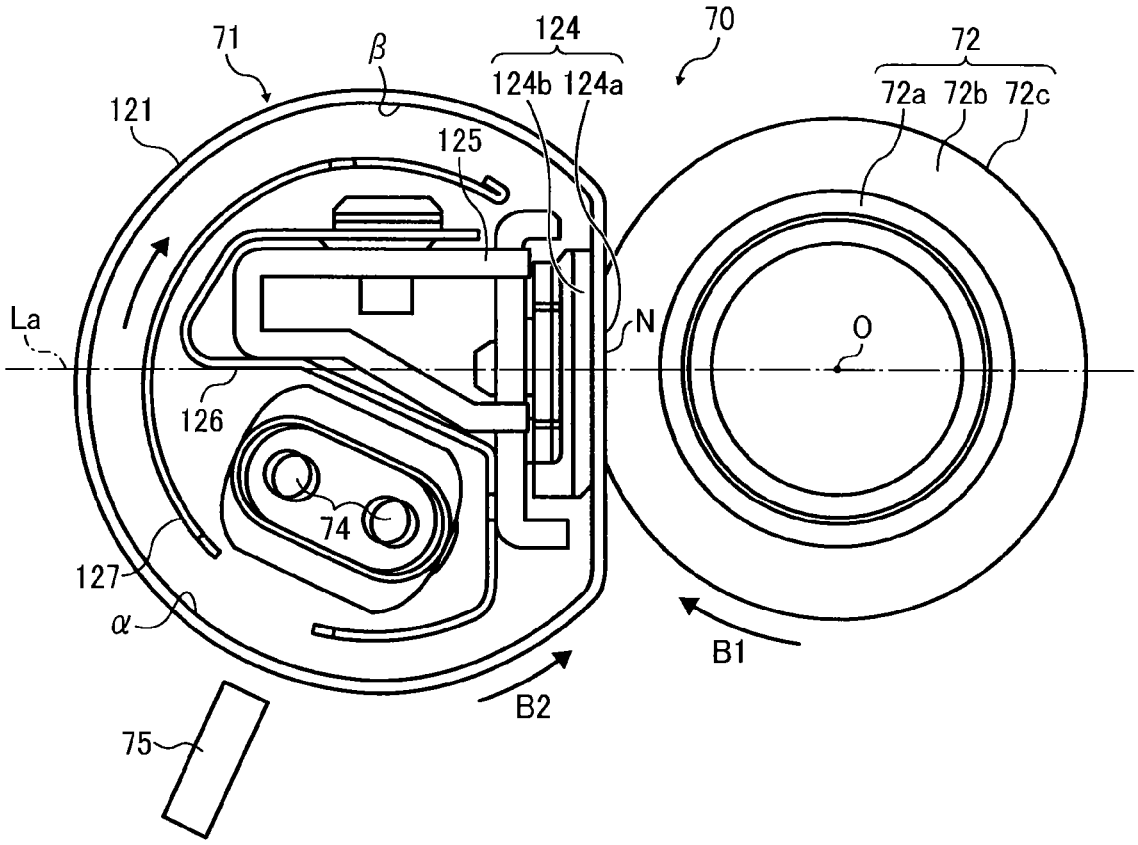
FIG. 5 is a cross-sectional view illustrating an exemplary fixing device (without the heat shielding system) provided in the image forming apparatus according to one embodiment of the present invention.

In this embodiment, as shown in FIG. 5, the fixing belt 121 has a heated area α facing the heat source 74 to be directly heated by the heat source 74 and an unheated area β not directly heated by the heat source 74 along its circumferential region. The other members (e.g. the reflection member 126, the stay 125, and the nip forming member 124 or the like) intervene between the non-heated areas β and the heat 74 and are fixed to a side plate or the like.

When shielding of heat is needed, the shielding member 127 is disposed at one or two or more positions preset in the heated area α as shown in FIG. 4. For example, in accordance with a width of a conveyed sheet, the shielding member 127 is moved to a shielding position to shield an area, in which the sheet is not conveyed.

Whereas, when heat insulation is not needed, the shielding member 127 is moved toward the non-heated area β to entirely evacuate toward backsides of the reflecting member 126 and the stay 125.

Hence, by rotating the shield member 127 and changing the heated area α of the fixing belt 121, a quantity of the radiant heat emitted from the heat source 74 to the fixing belt 121 can be adjusted. Since it requires heat resistance, the shielding member 127 is preferably made of metal, such as aluminum, steel, stainless steel, etc., or ceramic.

Here, the fixing device 70 is not limited to the above-described configuration composed of the fixing belt 121 having a so-called single-axis type and the pressing member 72 as described above. Specifically, a system composed of a two-axle type fixing belt and a pressing member can be employed as well, for example.

Now, a fixing process executed in a conventional image forming apparatus having a similar optical sensor that detects a smoothness as the optical sensor 50 according to one embodiment of the present invention is described with reference to FIG. 6.

Figure 6:
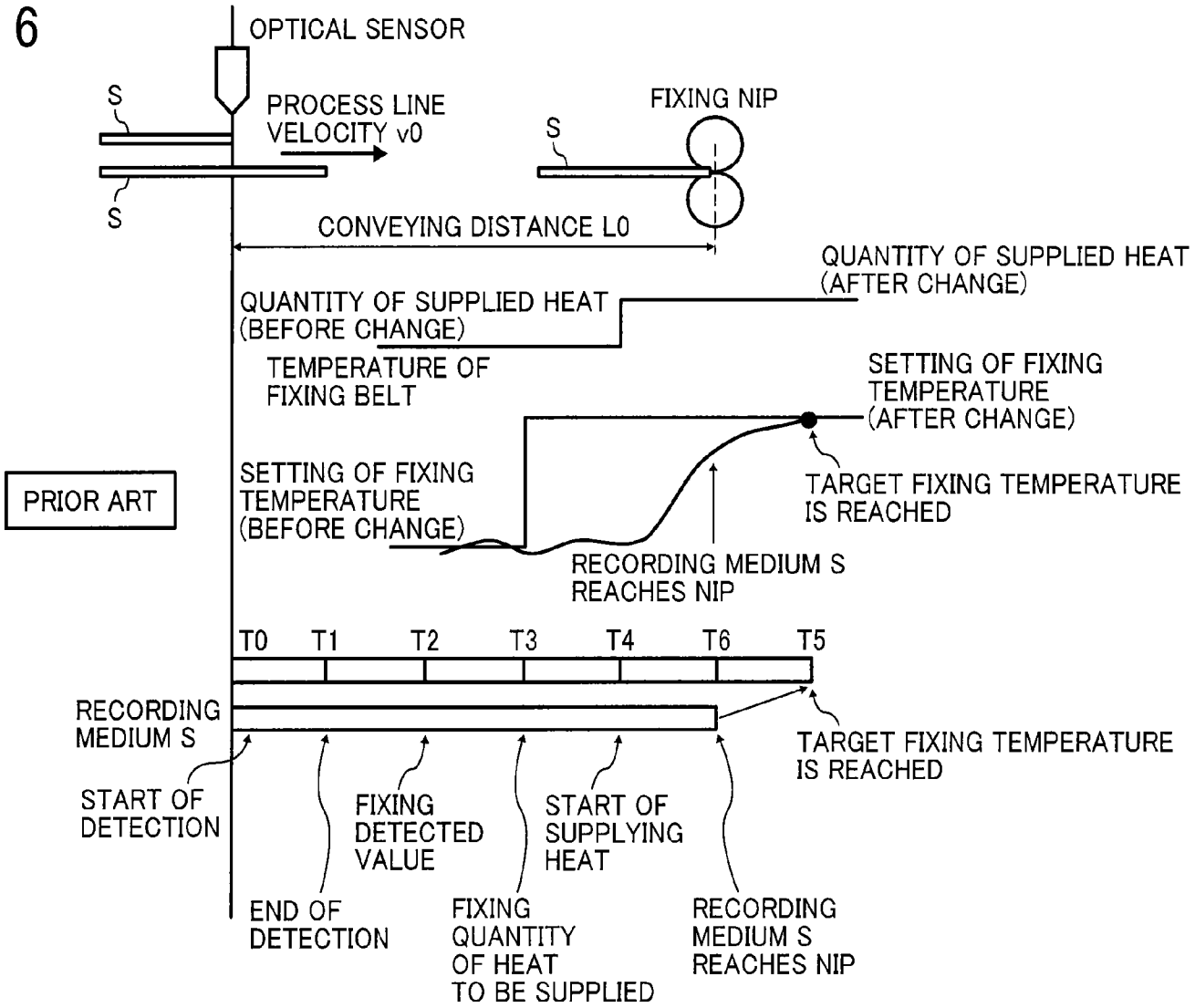
FIG. 6 is a timing chart illustrating a fixing process implemented by a conventional fixing device.

As shown in FIG. 6, in a conventional fixing processing, when a tip of the recording medium S reaches an optical sensor, the optical sensor starts detecting the smoothness of the recording medium S (at a time T0). Here, the time T0 means when the tip of the recording medium S reaches a position opposed to the optical sensor.

Afterwards, the optical sensor conducts detection of the recording medium S conveyed at a process line speed v0 up to a time T1 from the time T0. Specifically, the detection of the recording medium S is completed at the time T1. In this process, the optical sensor emits laser light from a light source to the surface of the recording medium S through a collimating lens up to the time T1.

Subsequently, the laser light is regularly reflected by the surface of the recording medium S, and passes through the aperture and enters a reflected light (regularly reflected light) receiver. Here, the time period T1 means an enough time period needed by the optical sensor to complete detection of the smoothness of the recording medium S conveyed at the process line speed v0 from the time T0.

However, the detection by the optical sensor 50 can be completed at either a time when the end of the recording medium S reaches the optical sensor 50 or a given time point during conveyance of the recording medium S. In this embodiment, however, the time T1 is a time when the end of the recording medium S reaches the optical sensor 50.

Subsequently, at a time T2, a value detected by the optical sensor up to the time T1 is fixed by the control unit.

Here, the sensor value may be fixed by either an average of voltages detected by the light receiver 54 from the time T0 to the time T1, or the minimum value among the voltages thereof, for example. The time period T2 represents an enough time period needed by the control unit 56 of the optical sensor 50 to fix the sensor value detected by the optical sensor up to time T1.

At a time T3 coming after the sensor value detected by the optical sensor has been fixed, the control circuit 73 determines a quantity of heat supplied in accordance with the fixed sensor value. Specifically, the control circuit 73 determines setting (i.e., a target) of fixing temperature in the nip N of the fixing device 70.

Here, the setting of fixing temperature can be determined with reference to a relational table stored in a memory provided in a memory unit 302 or the like, in which settings of fixing temperature and voltages are related based on a correlation between smoothness of a recording medium S and setting of fixing temperature experimentally sought in advance. Otherwise, the setting of fixing temperature can be determined based on a detected smoothness by using a formula stored in a memory of the memory unit 302, etc., based on the correlation between smoothness of a recording medium S and setting of fixing temperature experimentally sought in advance.

At a time T4 after the setting of fixing temperature is determined, to render temperature of the nip N of the fixing device 70 to be the setting of fixing temperature, the heat source 74 starts supplying heat to the fixing member 121. Subsequently, at a time T5, temperature of the nip N of the fixing unit 71 reaches the setting of fixing temperature.

Whereas, the recording medium S is conveyed after its tip reaches the optical sensor 50 at the time T0 by a conveying distance L0 up to the nip N of the fixing device 70 at the process line speed v0, and reaches the nip N thereof at a time T6 (i.e., T6=T0+L0/v0).

However, in such a conventional fixing process of the image forming apparatus, the recording medium S has reached the fixing nip N at the time T6 before the fixing device 70 reaches the fixing temperature at the time T5. Because of this, the conventional image forming apparatus cannot execute a fixing process at the setting of fixing temperature determined in accordance with the recording medium S as a problem.

Therefore, in an image forming apparatus 1 according to one embodiment of the present invention, temperature of the fixing device 70 is controlled to reach the setting of fixing temperature before the recording medium S reaches the nip N of the fixing device 70. Specifically, in one embodiment of the present invention, the following inequality is established; T6>T5.

When the inequality (T6>T5) is established, a recording medium S with its smoothness detected is desirably an object, onto which a toner image is fixed at a setting of fixing temperature determined based on the detected smoothness. In such a situation, the recording medium S with its smoothness detected can be immediately fixed at the setting of fixing temperature having already been changed.

Figure 7:
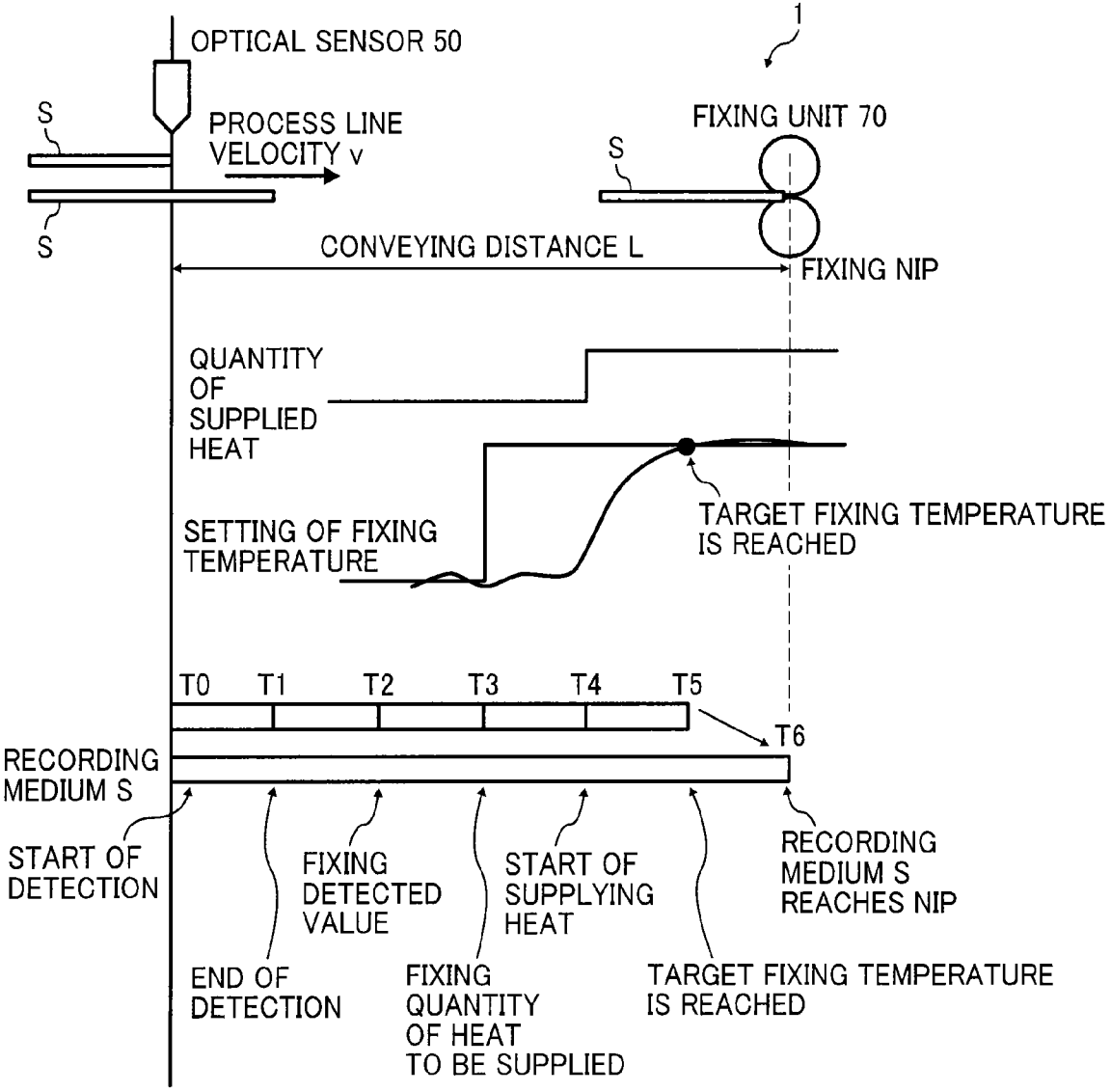
FIG. 7 is a timing chart illustrating an exemplary fixing process implemented by an image forming apparatus according to one embodiment of the present invention.

As shown in FIG. 7, an image forming apparatus 1 according to one embodiment of the present invention is enabled to establish the inequality (T6>T5) on a condition that a recording medium S with its smoothness detected is immediately subjected to a fixing process at setting of fixing temperature determined based on the detected smoothness. Here, the above-described time T5 is equivalent to a time Ta in one embodiment of the present invention. The above-described time T6 corresponds to a time Tb in one embodiment of the present invention.

Figure 8:
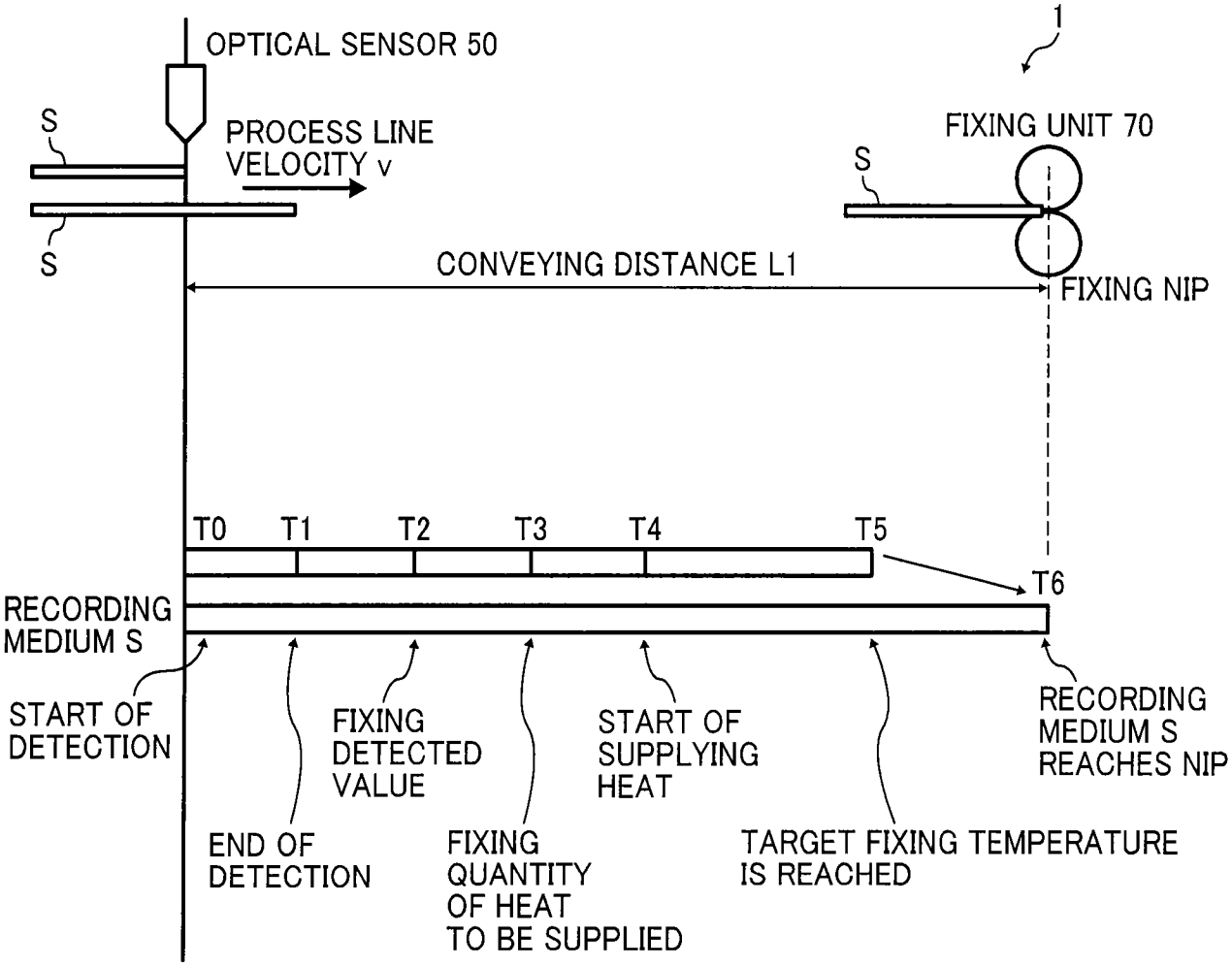
FIG. 8 is a timing chart illustrating a sheet conveying distance between an optical sensor and a fixing device provided in the image forming apparatus according to one embodiment of the present invention.

Specifically, as shown in FIG. 8, the sheet conveying distance L1 between the nip N of the fixing device 70 and the optical sensor 50 is set longer than a conventional length L0 in this embodiment. That is, the conveying distance L1 is longer than the conventional conveying distance L0.

More specifically, when it is supposed that a process line speed of the recording medium S is represent by v and is fixed thereto, while a conveying distance between the optical sensor 50 and the nip N of the fixing device 70 is represented by L1, and accordingly a time T6 is thereby calculated by a formula of L1/v, a conveying distance L1 (i.e., >L0) is determined and set to meet an inequality of T6>T5. Therefore, in this embodiment, the optical sensor 50 is placed at a position capable of ensuring the above-described conveying distance L1.

Here, the process line speed v is sometimes difficult to be optionally changed due to limitation of performance of a sheet conveying motor, not shown. In such a situation, as mentioned above, by appropriately setting the conveying distances L1, i.e. locating the optical sensor 50 at an appropriate position, the inequality T6>T5 can be established even if the performance of the sheet conveying motor is limited.

In addition to the above-described example, due to tendency of downsizing of the image forming apparatus 1 in recent years, the conveying distance L1 between the nip N of the fixing device 70 and the optical sensor 50 cannot be sufficiently obtained sometimes.

Figure 9:
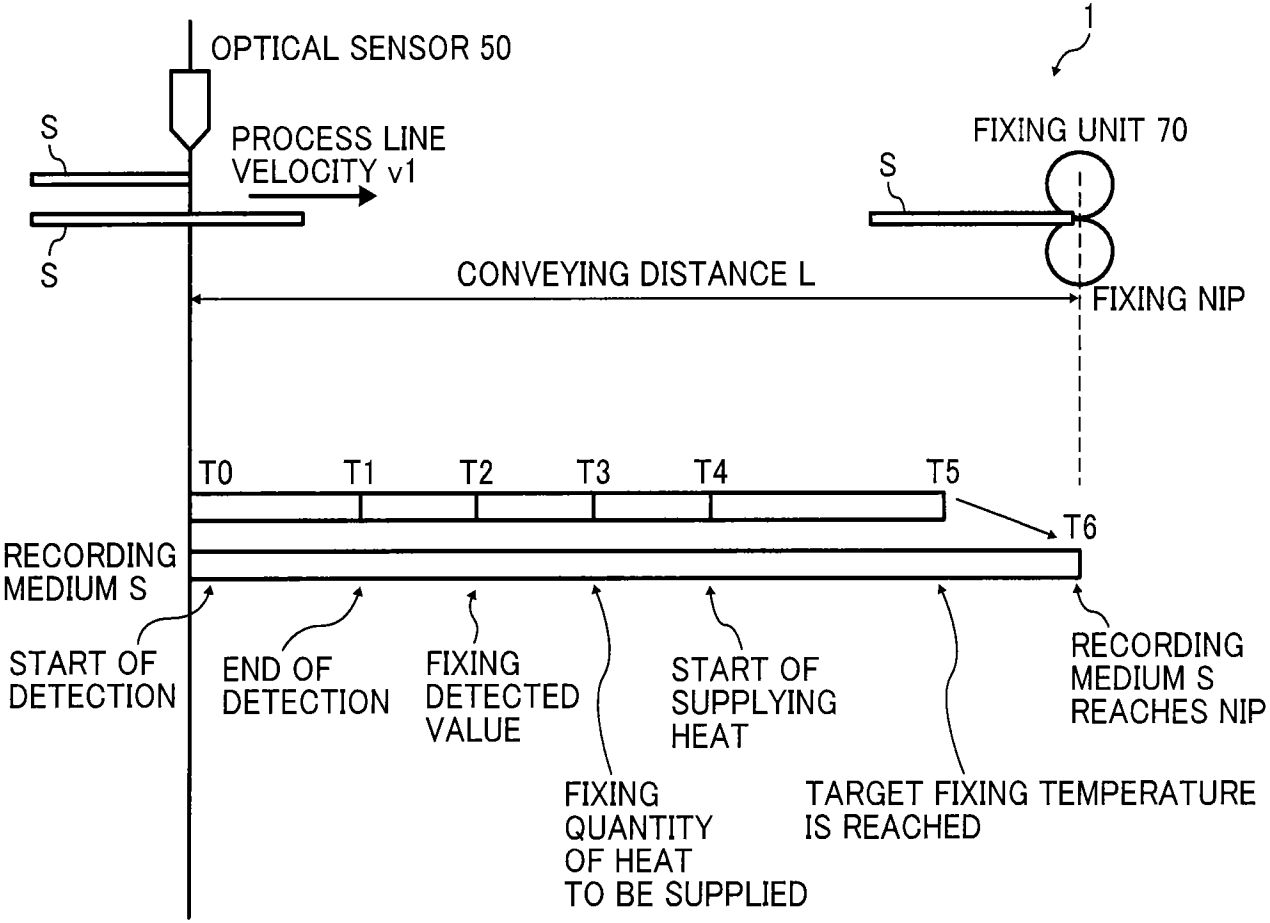
FIG. 9 is a timing chart illustrating a sheet conveying speed at which a sheet is conveyed in the image forming apparatus according to one embodiment of the present invention.

In such a situation, the process line speed v may be rendered slower than the conventional process line speed v0 as shown in FIG. 9. That is, the process line speed v1 of this embodiment can be set slower than the conventional process line speed v0. For example, the process line speed v1 is a half of the conventional process line speed v0 (i.e., v1=v0/2). In more specifically, by fixing the conveying distance L, the process line speed v1 can be determined and set to be able to establish the inequality T6>T5.

Hence, by slowing down the process line speed v1 like this, the time period T6 can be set longer without changing the sheet conveying distance L. As a result, the inequality T6 >T5 can be established again.

Here, (as shown in FIG. 6) a setting of fixing temperature before changing is a level to be detected when the fixing device 70 has completed its warming-up. Therefore, the above-described time T5 (see FIG. 9) means a time when the fixing device 70 having been warmed-up reaches a setting of fixing temperature (newly) determined and set (or allocated) to the recording medium S.

In this embodiment, the sensor value of the recording medium S used to determine the setting of fixing temperature is obtained by averaging multiple sensor values detected at multiple sections thereof by the optical sensor 50 within a prescribed time period. In other words, the heat source controlling circuit 73 of this embodiment determines the setting of fixing temperature using the average of the sensor values detected by the optical sensor 50 within the prescribed time period.

Figure 10:
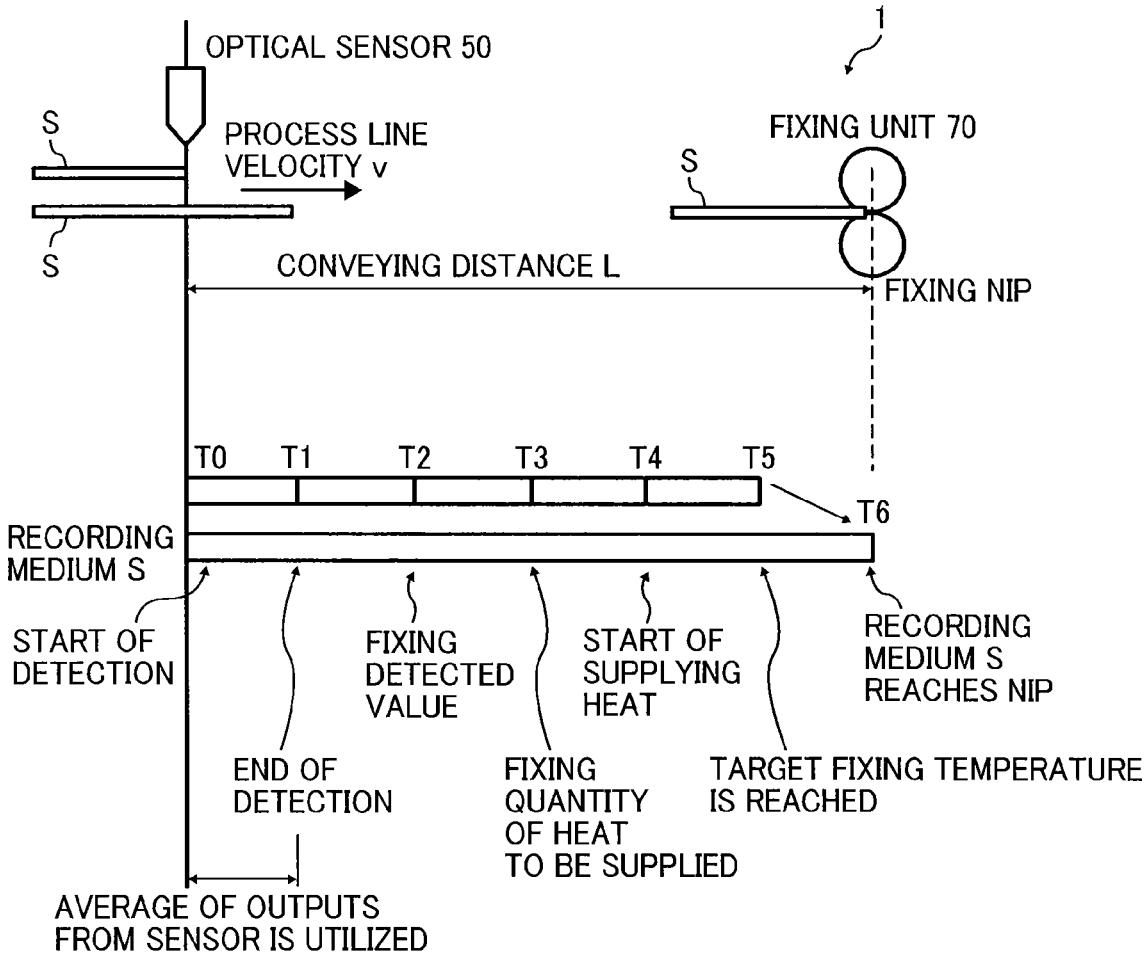
FIG. 10 is a timing chart illustrating an exemplary method of detecting a smoothness of the recording medium using an optical sensor in the image forming apparatus according to one embodiment of the present invention.

Further, as shown in FIG. 10, the above-described prescribed time period is a time period needed by the recording medium S to pass through the optical sensor 50 (i.e., a time period from the time T0 to the time T1). Therefore, the heat source controlling circuit 73 determines the setting of fixing temperature using the average of the sensor values detected at the multiple sections of the recording medium S.

With this, an amount of information related to the smoothness of the recording medium S can be enhanced, and an averaged smoothness of the used recording medium S can be more accurately detected. In such a situation, a variation of the sensor value can be suppressed even when the recording medium S slightly bends or distorts, for example, during its conveyance. Because of this, the sensor value of the recording medium S can be accurately obtained constantly.

Further, as described earlier, the image forming apparatus 1 according to one embodiment of the present invention is configured to change an image forming condition in accordance with the smoothness of the recording medium S detected by the optical sensor 50. Specifically, the CPU 301 changes these image forming conditions.

For this reason, the above-described image forming apparatus 1 according to one embodiment of the present invention is configured to appropriately change the above-described image forming condition as described below. That is, the detected smoothness of the recording medium S is reflected to the image forming condition as described herein below.

Figure 11A:
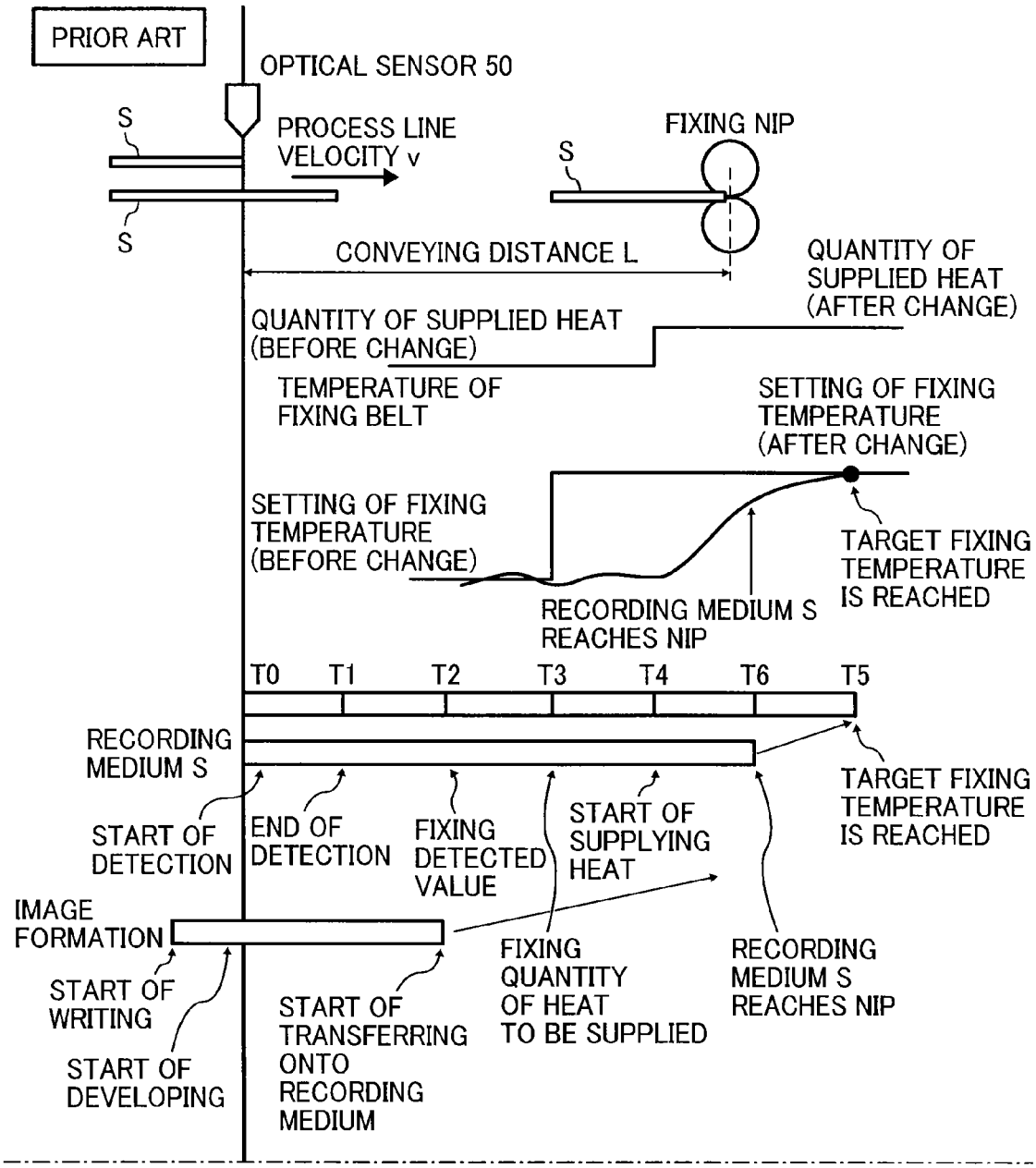
FIGS. 11A and 11B are timing charts collectively illustrating an exemplary image formation sequence performed by the image forming apparatus according to one embodiment of the present invention.
Figure 11B:
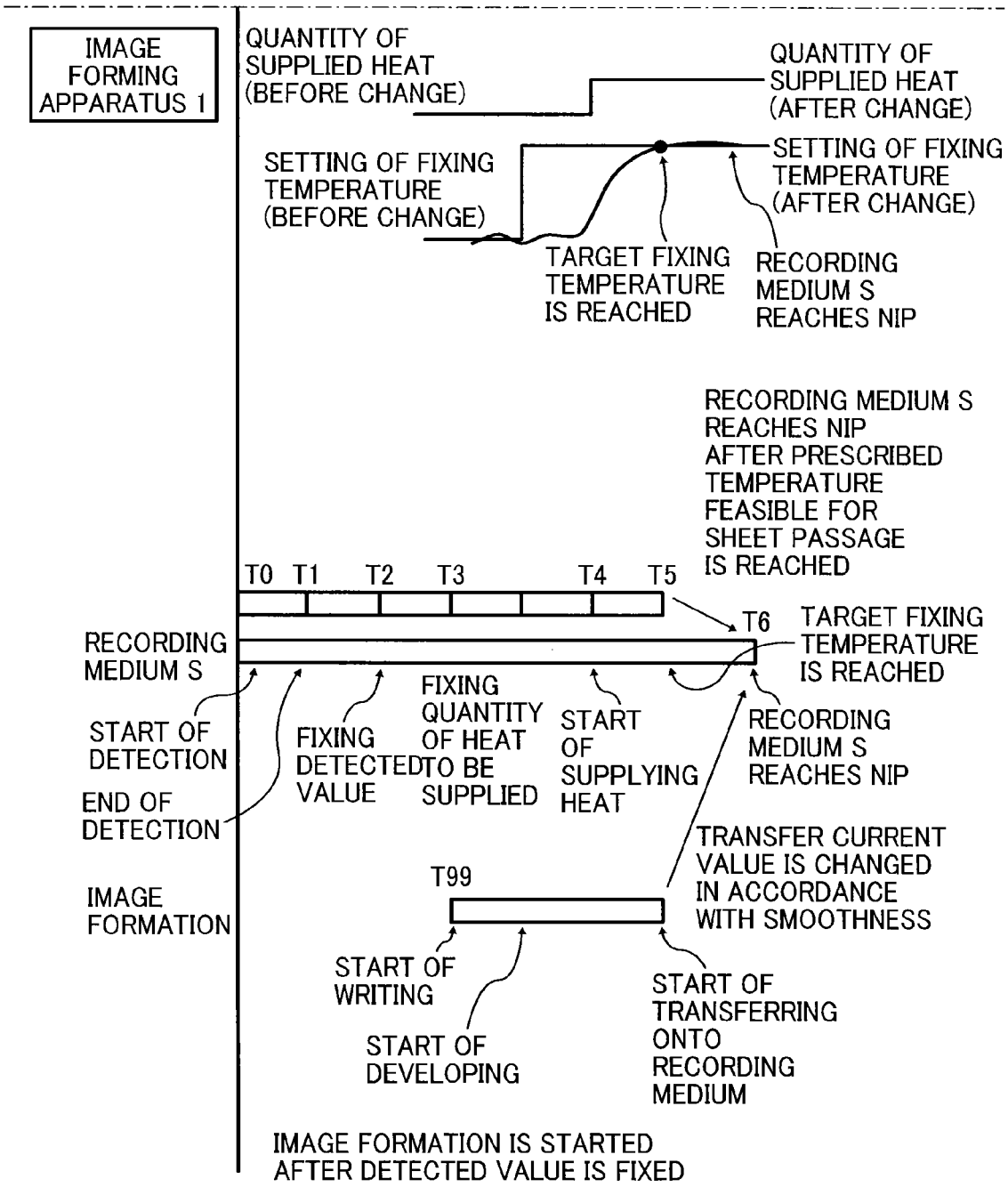

Specifically, as shown in FIG. 11B, the image forming apparatus 1 according to one embodiment of the present invention is configured to satisfy an inequality of T99>T2 beside that of T6>T5. Here, the time T2 represents a time period needed to confirm the sensor value detected by the optical sensor 50 after the tip of the recording medium S is detected by the optical sensor 50. Whereas the time T99 represents a time period needed to start the image forming operation based on the image forming condition determined and set to the recording medium S (after the tip of the recording medium S is detected by the optical sensor 50). The above-described times T2 and T99 correspond to times Tc and Td, respectively, according to the present invention.

Here, in this embodiment of the present invention, a reference of the start of the image formation corresponds to a time when the exposing unit 20 starts writing of a latent image for each color toner image onto each of the image-bearing members 31 provided in the image forming devices 30*c*, 30*m*, 30*y*, and 30*k*, respectively.

In this way, when the time relation T99>T2 is established, the image forming condition can be changed beforehand in accordance with the smoothness of the recording medium S. Especially, since the sensor value obtained by the optical sensor 50 is fixed before the exposing unit 20 starts writing, image processing, developing, and transferring conditions can be optimally set in accordance with the smoothness of the recording medium S.

For example, the CPU 301 of one embodiment of the present invention changes (a manner of forming) a latent image written into the image-bearing member 31, for example, by changing a manner of processing an image, based on the sensor value obtained by the optical sensor 50.

Figure 12A:
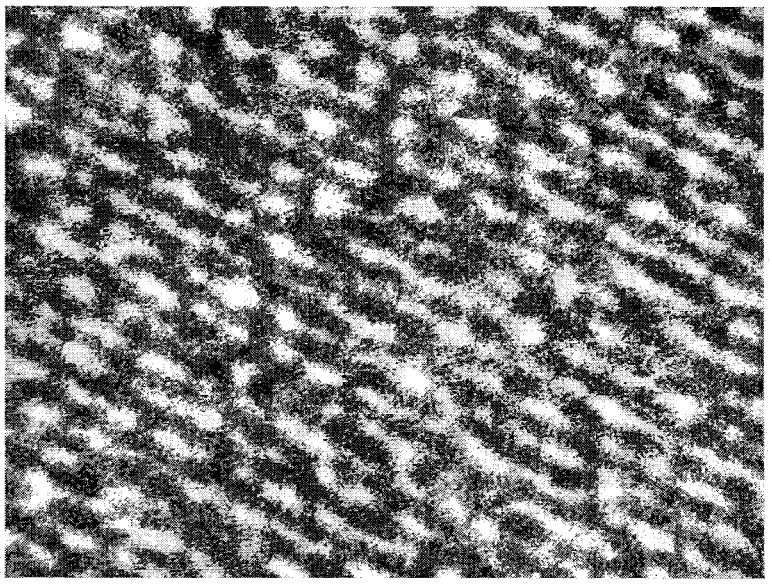
FIGS. 12A and 12B are diagrams collectively illustrating exemplary changes in an image processing condition implemented in the image forming apparatus according to one embodiment of the present invention.
Figure 12B:
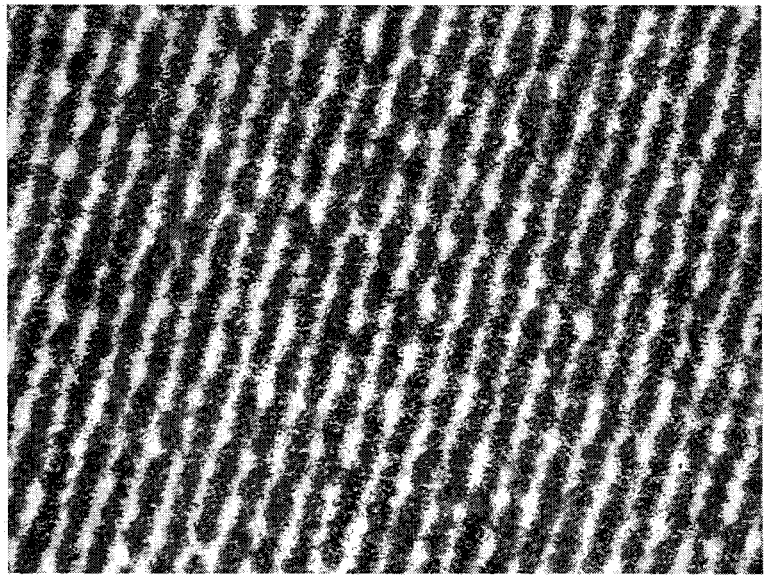

As shown in FIGS. 12A and 12B, fixing performance easily deteriorates, especially, at a halftone portion in the image, when the recording medium S having a low smoothness is used. Because of this, in accordance with the level of the smoothness of the recording medium S, the image processing manner is changed at the halftone portion.

Specifically, as shown in FIG. 12A, the CPU 301 of this embodiment carries out diffusion processing to a recording medium S having a high smoothness. Whereas, as shown in FIG. 12B, the CPU 301 carries out line processing to a recording medium S having a low smoothness instead of the diffusion processing. With this, strength of adhesion between particles of toner (T) can be likely enhanced even when the recording medium S having a particularly low smoothness is used. Thus, even when the recording medium S having the particularly low smoothness is used, an appropriate quantity of heat can be supplied while reducing power consumption without causing defective fixing.

Further, the CPU 301 of this embodiment is enabled to change a condition of a transferring process applied to the recording medium S in accordance with the sensor value obtained by the optical sensor 50. For example, when the image processing condition is changed to the line processing as described above, the CPU 301 further changes an amount of transfer current suitable for the line processing.

Here, the amount of transfer current can be determined with reference to a relational table stored in the memory unit 302, in which a relation between a voltage and an amount of transfer current is listed (described) based on a correlation between a smoothness of the recording medium S, an amount of transfer current, and (quality of) an image, previously experimentally sought. Otherwise, the amount of transfer current can be determined based on the detected smoothness by using a formula stored in a memory of the memory unit 302, for example, based on the correlation between the smoothness of the recording medium S and an amount of transfer current and (quality of) the image, previously experimentally sought.

Further, the CPU 301 of this embodiment is configured to change the process line speed v in accordance with the sensor value of the optical sensor 50. That is, when the smoothness of the recording medium S is too low to ensure sufficient image quality simple by changing the fixing temperature alone, accordingly, compensation by increasing the fixing temperature is not sufficient, a sufficient fixing nipping time is ensured by reducing the process line speed v. With this, even when the recording medium S having the particularly low smoothness is used, an appropriate quantity of heat can be supplied without causing the defective fixing.

Figure 13A:
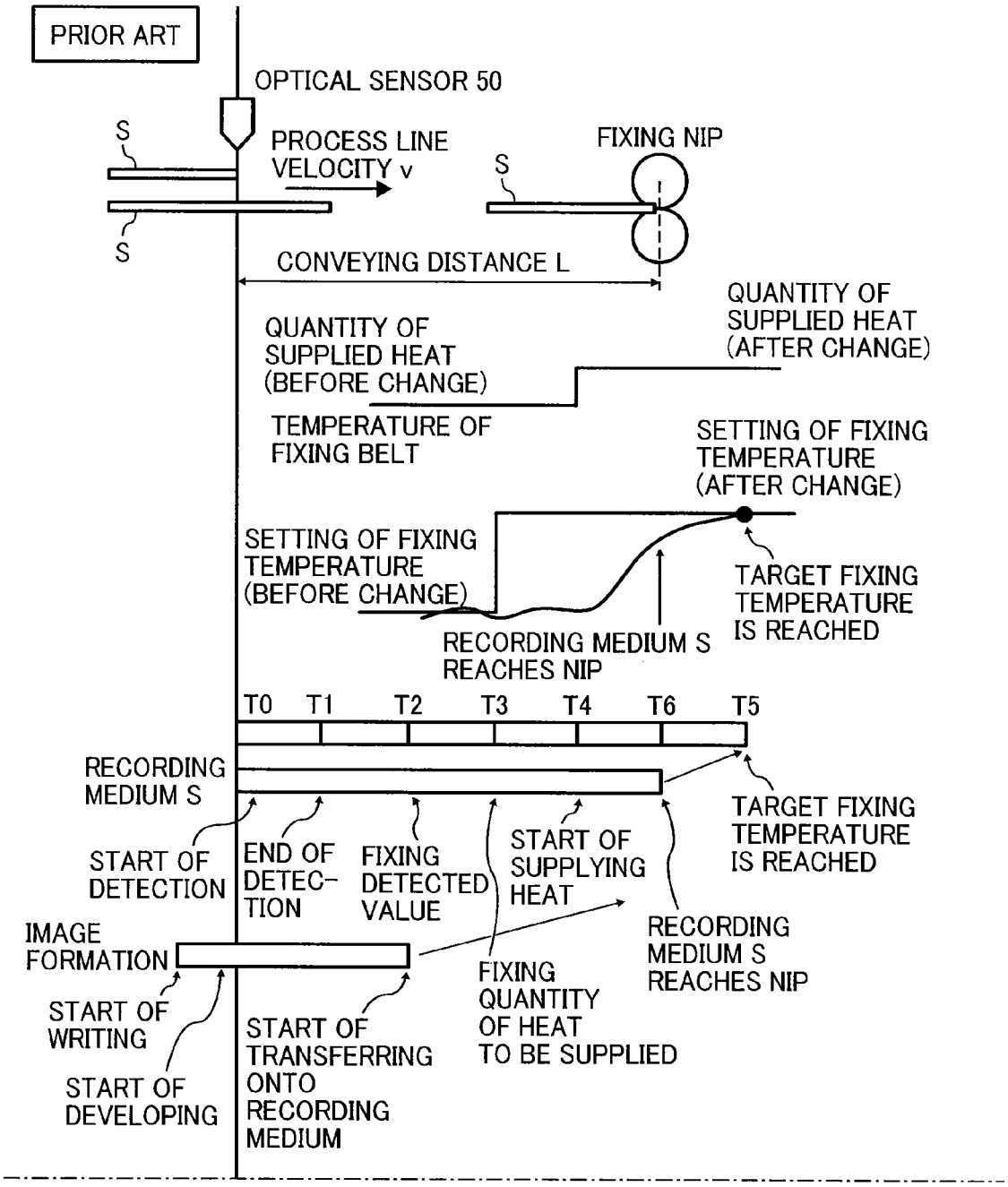
FIGS. 13A and 13B are timing charts collectively illustrating an exemplary change in a transfer condition employed in the image forming apparatus according to one embodiment of the present invention.
Figure 13B:
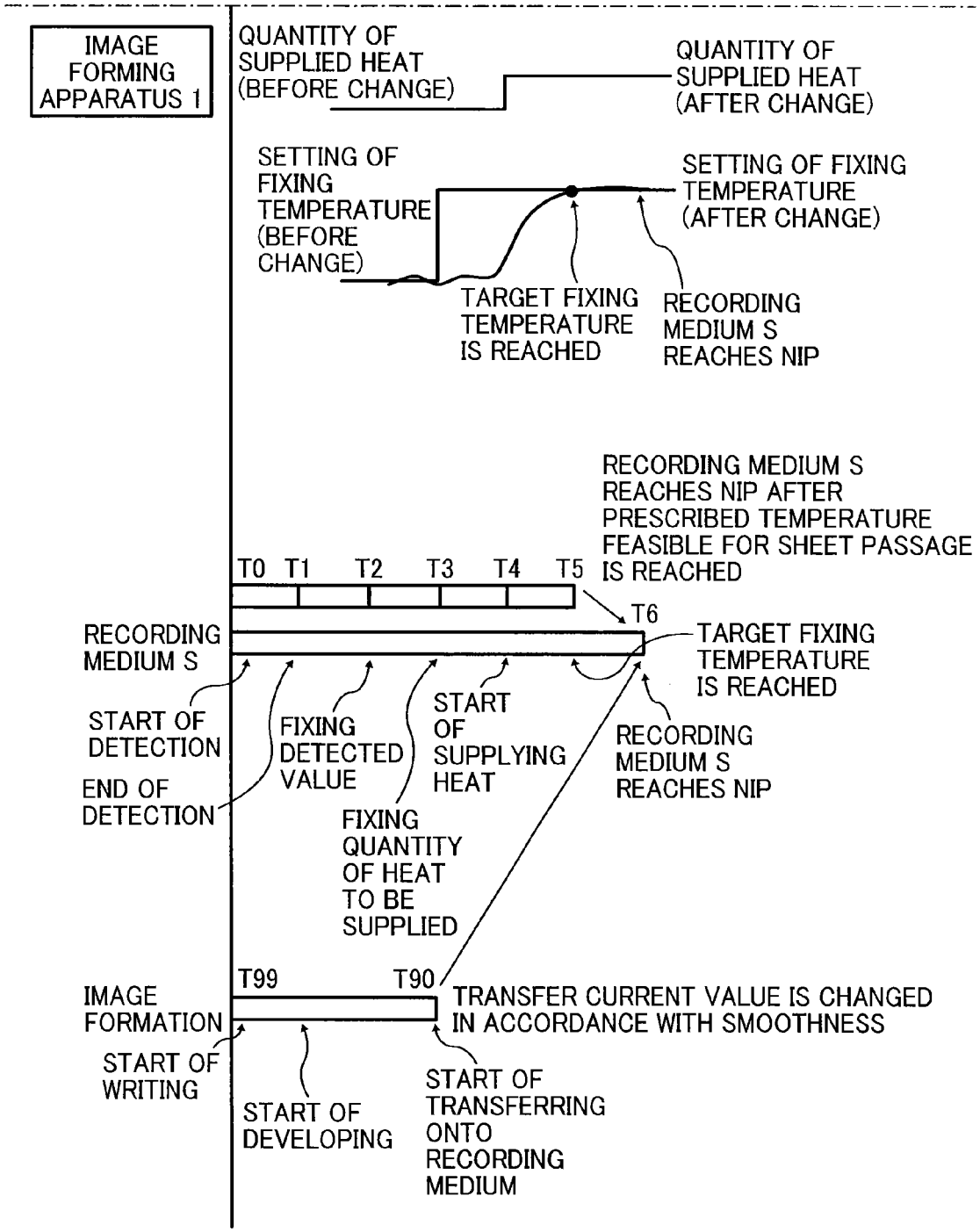

Further, as shown in FIG. 13B, in this embodiment, the CPU 301 is configured to change the condition of the above-described transferring process on a condition that the time relation T90>T2>T99 is established. Here, T90 represents a time after the tip of the recording medium S is detected by the optical sensor 50 until the transferring process starts (i.e., transferring operation) onto the recording medium S. In such a situation, the above described time relation T6>T5 can be established again. Here, the time T90 of this embodiment corresponds to a time Te of one aspect of the present invention.

In this way, when the time relation T90>T2>T99 is established, the transferring conditions can be changed in advance in accordance with the smoothness of the recording medium S. For example, since the sensor value of the optical sensor 50 has been fixed before the transferring process applied onto the record medium S starts, the CPU 301 can change the above described amount of transferring current in accordance with the smoothness of the recording medium S.

Hence, in the image forming apparatus 1 according to one embodiment of the present invention, the time period T6 starting from when the tip of the recording medium S is detected by the optical sensor 50 to when the recording medium S reaches the fixing device 70 is set longer than the time period T5 (starting when the tip of the recording medium S is detected by the optical sensor 50 to) when the setting of fixing temperature set (or allocated) to the recording medium S with its tip detected by the optical sensor 50 is reached. For this reason, the fixing temperature can be enhanced up to the setting of fixing temperature before the recording medium S with its tip detected by the optical sensor 50 reaches the fixing device 70.

Therefore, the recording medium S having reached the nip N of the fixing device 70 can be subjected to the fixing process under an optimum setting of living temperature. As a result, since proper calorie can be supplied to the recording medium S, defective fixing of the toner image onto the recording medium S can be likely prevented. Further, since excessive quantity of heat is not supplied to the recording medium S, reduction of power consumption can be also promoted as well.

Further, according to one embodiment of the present invention, the image forming apparatus 1 can reflect the change in fixing condition, under which the recording medium S having reached the nip N of the fixing device 70, in accordance with the own smoothness of the recording medium S. That is, according to one embodiment of the present invention, the image forming apparatus 1 can appropriately set the fixing condition in accordance with the type of recording medium S.

Further, according to one embodiment of the present invention, the image forming apparatus 1 is configured to delay the time T99 when image forming operation is started than the time T2 when the sensor value of the optical sensor 50 is fixed. Because of this, the image forming condition for the recording medium S can be changed in accordance with the own smoothness of the recording medium S. Accordingly, according to one embodiment of the present invention, the image forming apparatus 1 can appropriately set the fixing condition in accordance with the type of recording medium S in other words.

Although the optical sensor 50 is placed in a direction capable of detecting a front surface of the recording medium S, on to which the color image is transferred, in this embodiment, the present invention is not limited thereto, and the optical sensor 50 can be arranged in a direction capable of detecting a back side of the recording medium S when the front surface of the recording medium S is difficult to detect due to restrain of its layout, for example.

Further, in this embodiment, although the time T1 represents a time when the trailing end of the recording medium S reaches the optical sensor 50, the present invention is not limited thereto, and the time T1 can be a time when the recording medium S passes through a prescribed position other than the optical sensor 50, for instance.

Figure 14A:
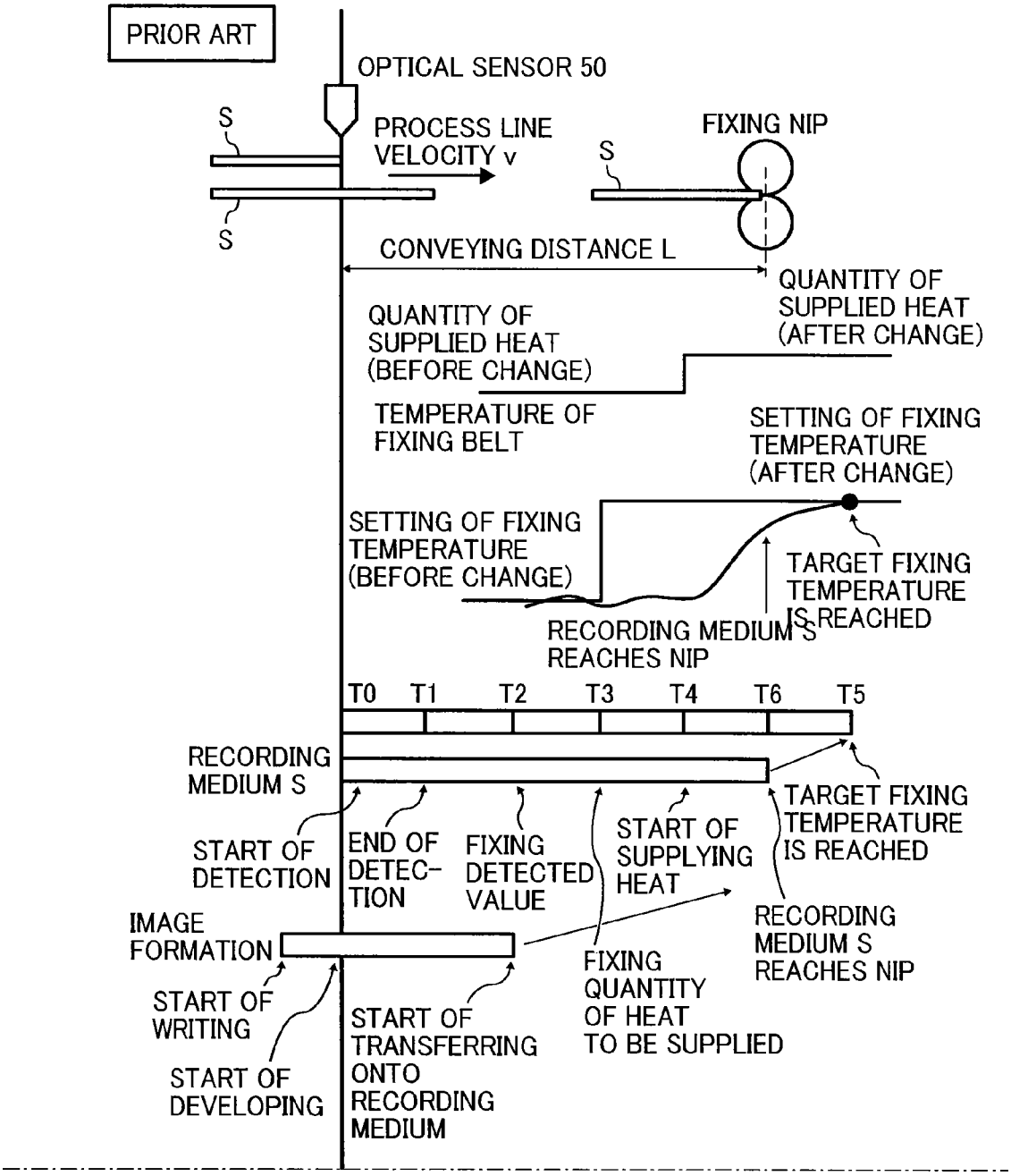
FIGS. 14A and 14B are timing charts collectively illustrating a modification of a fixing process implemented in the image forming apparatus according to one embodiment of the present invention.
Figure 14B:
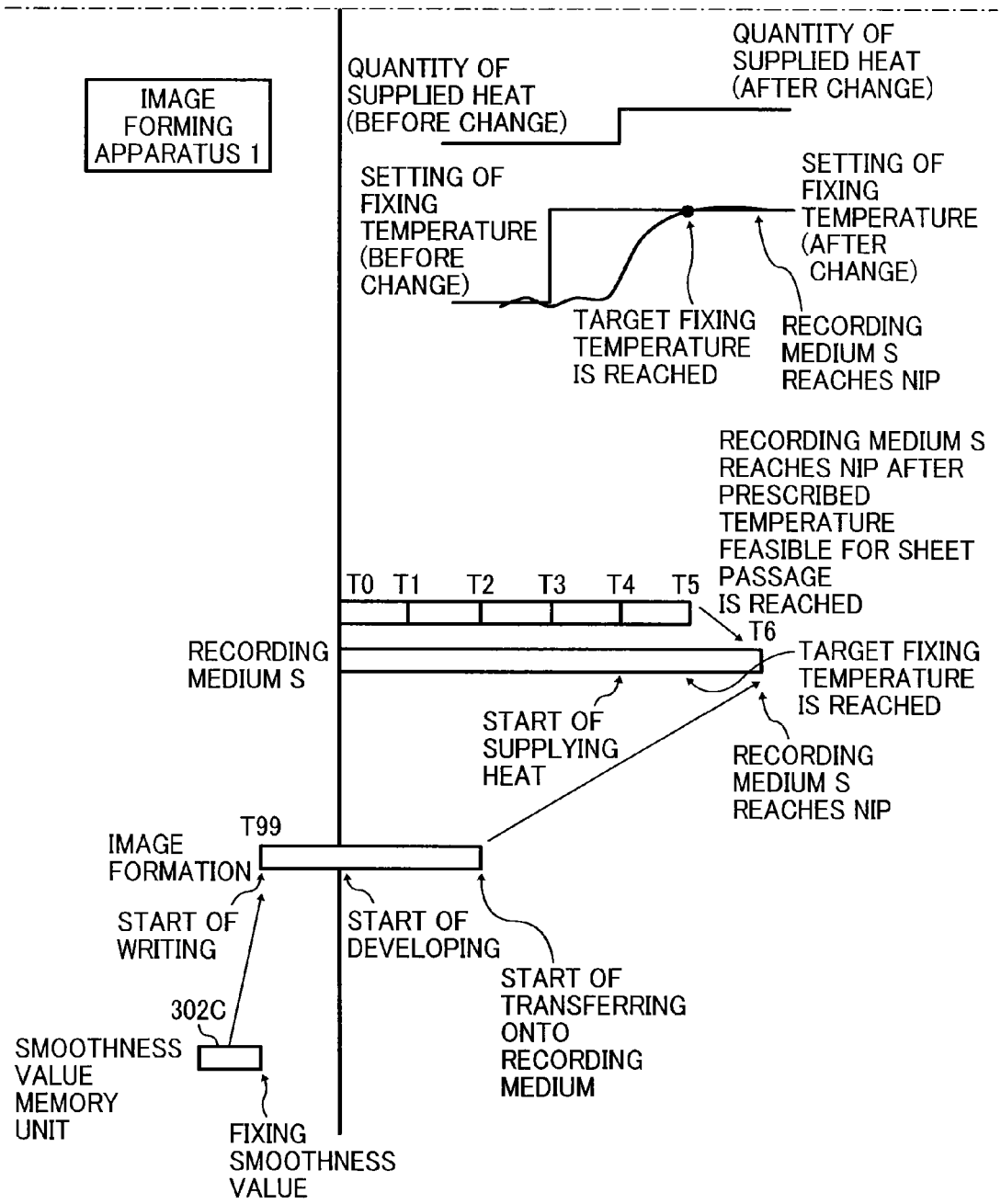
Figure 15:
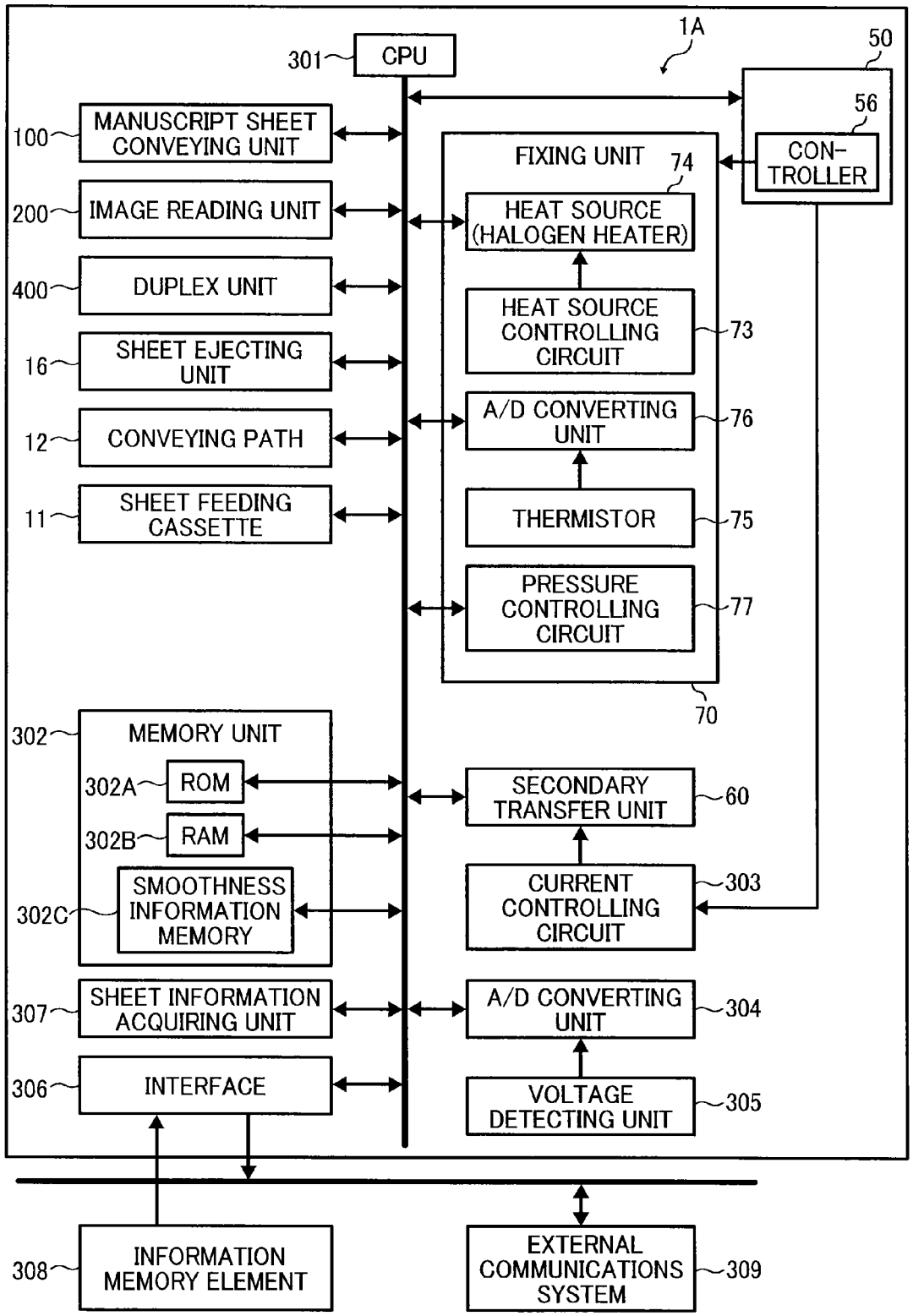
FIG. 15 is a block diagram illustrating an exemplary function of the image forming apparatus of FIG. 14B.

Further, although the above-described embodiments do not include a memory for storing the smoothness of the recording medium S, the present invention is not limited thereto, and the present invention can be applied to the image forming apparatus 1A having a smoothness memory unit 302C for storing the smoothness of the recording medium S, for example, as shown in FIGS. 14B and 15.

In such a situation, the CPU 301 changes the image forming condition in accordance with the sensor value of the optical sensor 50 stored in the smoothness memory unit 302C. Specifically, the CPU 301 changes the smoothness of the recording medium S when starting the image forming process (operation). Specifically, the heat source controlling circuit 73 changes the fixing condition including the setting of fixing temperature in accordance with the smoothness of the recording medium S stored in the smoothness memory unit 302C when image forming operation starts. Here, the smoothness memory unit 302C constitutes a memory unit of the present invention.

In such an image forming unit 1A, the smoothness of the recording medium S obtained in previous image forming operation is stored in advance in the smoothness memory unit 302C. Subsequently, the image forming unit 1A obtains the smoothness previously obtained in the former image formation, for example, from the smoothness memories 302C and reflects it to current image formation. That is, in the image forming unit 1A, the smoothness of the recording medium S is obtained before the writing process executed by the exposing unit 20 in the current image formation. Because of this, the image formation and fixing conditions can be changed to optimum levels, respectively, in accordance with the smoothness of the recording medium S even though the process line speed v or the sheet conveying distance L between the optical sensor 50 and the fixing device 70 is strictly limited.

According to one embodiment of the present invention, an image forming apparatus and a method of positioning a detector properly set fixing and image forming conditions in accordance with a type of a transfer member.

Numerous additional modifications and variations of the present invention are possible in light of the above teachings. It is therefore to be understood that within the scope of the appended claims, the present invention may be executed otherwise than as specifically described herein. For example, the order of steps for forming the image forming apparatus is not limited to the above-described various embodiments and can be appropriately changed.

What is claimed is:

1. An image forming apparatus, comprising:

an image forming device to form a toner image on a recording medium under a prescribed image forming condition;

a fixing device to fix the toner image borne on the recording medium thereonto by heating the recording medium based on a target fixing temperature; and a detector to detect the type of recording medium, the type being used in setting at least one of the image forming condition and the target fixing temperature, wherein the recording medium is conveyed at a prescribed process line speed at least until the tip of the recording medium reaches the fixing device after the tip of the recording medium reaches the detector, and wherein Tb >Ta, where Ta represents a time period needed to reach a setting of fixing temperature allocated to the recording medium with its tip detected by the detector after detection of the tip and Tb represents a time period needed for the recording medium with its tip detected by the detector to reach the fixing device after detection of the tip.

2. The image forming apparatus as claimed in claim 1, wherein the detector is a smoothness detector configured to detect a smoothness of the surface of the recording medium by detecting an quantity of regular light emitted to the recording medium from a light source and reflected in a specular direction therefrom;

wherein Td >Tc, where Tc represents a time period after the tip of the recording medium is detected by the smoothness detector until a detected value is fixed and Td represents a time period after the tip of the recording medium is detected by the smoothness detector until the image forming device starts image forming operation based on the image forming condition allocated to the recording medium.

3. The image forming apparatus as claimed in claim 1, wherein a distance L between the detector and the fixing device is set to meet the inequality Tb >Ta when a sheet conveying speed of the recording medium is v and is fixed thereto and a time when the fixing device is reached by the recording medium is represented by Tb =L/v.

4. The image forming apparatus as claimed in claim 1, wherein a sheet conveying speed v of the recording medium is set to meet the inequality Tb >Ta when a distance between the detector and the fixing device is represented by L and fixed thereto and a time when the fixing device is reached by the recording medium is represented by Tb =L/v.

5. The image forming apparatus as claimed in claim 2, further comprising a fixing controller to determine the target fixing temperature depending on a detected value detected by the smoothness detector, wherein the fixing controller determines the target fixing temperature based on an average of the detected values detected by the smoothness detector multiple times within a prescribed time period.

6. The image forming apparatus as claimed in claim 5, wherein the prescribed time period is a time when the recording medium passes through the smoothness detector after its tip is detected.

7. The image forming apparatus as claimed in claim 2, further comprising an image formation controller to change the image forming condition in accordance with the detected value detected by the smoothness detector, wherein the image formation controller changes a manner of writing a latent image on a photosensitive body by changing an image processing manner in accordance with the detected value detected by the smoothness detector.

8. The image forming apparatus as claimed in claim 7, wherein the image formation controller changes a transferring condition for the recording medium in accordance with the detected value detected by the smoothness detector.

9. The image forming apparatus as claimed in claim 7, wherein the image formation controller changes a sheet conveying velocity v in accordance with the detected value detected by the smoothness detector.

10. The image forming apparatus as claimed in claim 8, wherein the image formation controller changes the transferring condition on a condition that a time relation Te >Tc >Td is established when Te represents a time period from when the tip of the recording medium is detected by the smoothness detector to when a transferring process is initiated to the recording medium.

11. The image forming apparatus as claimed in claim 7, further comprising a memory to store the detected value detected by the smoothness detector, wherein the image formation controller changes the image forming condition in accordance with the detected value obtained by the smoothness detection method and stored in the memory when the image forming device starts image formation, wherein the fixing controller changes the fixing condition including the target fixing temperature in accordance with the detected value obtained by the smoothness detector and stored in the memory when the image forming device starts image formation.

12. The image forming apparatus as claimed in claim 1, wherein the time Ta represents a time in which a warmed-up fixing device reaches the target fixing temperature allocated to the recording medium.

13. A method of arranging a detector in an image forming apparatus, the method comprising the steps of:

forming a toner image onto a recording medium under a prescribed image forming condition;

fixing the toner image borne on the recording medium thereonto by heating the recording medium based on target fixing temperature;

detecting the type of recording medium, the type being used in setting at least one of the image forming condition and the target fixing temperature;

conveying the recording medium at a prescribed process line speed at least until the tip of the recording medium reaches a fixing device after the tip of the recording medium reaches a detector; and arranging the detector to establish Tb >Ta, where Ta represents a time period needed for a fixing device to reach a setting of fixing temperature allocated to the recording medium with its tip detected by the detector after detection of the tip and Tb represents a time period needed by the recording medium to reach the fixing device after detection of the tip.

14. A method of arranging a detector in an image forming apparatus, the method comprising the step of:

forming a toner image onto a recording medium under a prescribed image forming condition;

fixing the toner image borne on the recording medium thereonto by heating the recording medium based on target fixing temperature;

detecting a smoothness of the surface of the recording medium by detecting an quantity of regular light emitted to the recording medium from a light source and reflected in a specular direction therefrom;

conveying the recording medium at a prescribed process line speed at least until the tip of the recording medium reaches a fixing device after the tip of the recording medium reaches a detector; and arranging the detector to establish Td >Tc, wherein Tc represents a time after a tip of the recording medium is detected by the smoothness detector until the detected value is fixed and Td represents a time until the image forming device starts image forming operation based on the image forming condition allocated to the recording medium after detection of the tip.

15. An image forming apparatus, comprising:

an image forming device to form a toner image on a recording medium under a prescribed image forming condition;

a fixing device to fix the toner image borne on the recording medium thereonto by heating the recording medium based on a target fixing temperature; and a detector to detect the type of recording medium, the type being used in setting at least one of the image forming condition and the target fixing temperature, wherein the detector is a smoothness detector configured to detect a smoothness of the surface of the recording medium by detecting a quantity of regular light emitted to the recording medium from a light source and reflected in a specular direction therefrom, wherein the target fixing temperature is based on an average of the detected values detected by the smoothness detector multiple times within a prescribed time period, and wherein Tb >Ta, where Ta represents a time period needed to reach a setting of fixing temperature allocated to the recording medium with its tip detected by the detector after detection of the tip and Tb represents a time period needed for the recording medium with its tip detected by the detector to reach the fixing device after detection of the tip.

* * * * *